US008417515B2

(12) United States Patent
Oshikiri et al.

(10) Patent No.: US 8,417,515 B2
(45) Date of Patent: Apr. 9, 2013

(54) ENCODING DEVICE, DECODING DEVICE, AND METHOD THEREOF

(75) Inventors: Masahiro Oshikiri, Kanagawa (JP); Hiroyuki Ehara, Kanagawa (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 11/596,085

(22) PCT Filed: May 13, 2005

(86) PCT No.: PCT/JP2005/008771

§ 371 (c)(1),
(2), (4) Date: Nov. 9, 2006

(87) PCT Pub. No.: WO2005/111568

PCT Pub. Date: Nov. 24, 2005

(65) Prior Publication Data

US 2008/0027733 A1 Jan. 31, 2008

(30) Foreign Application Priority Data

May 14, 2004 (JP) ..... 2004-145425
Nov. 5, 2004 (JP) ..... 2004-322953
Apr. 28, 2005 (JP) ..... 2005-133729

(51) Int. Cl.
*G10L 19/14* (2006.01)
*G10L 19/00* (2006.01)
*G10L 11/04* (2006.01)

(52) U.S. Cl.
USPC ..... 704/205; 704/200.1; 704/206; 704/500; 704/501

(58) Field of Classification Search ..... 704/500
See application file for complete search history.

(56) References Cited

U.S. PATENT DOCUMENTS 5,444,487 A * 8/1995 Kondo et al. ..... 375/240.03
5,687,191 A * 11/1997 Lee et al. ..... 375/216
(Continued)

FOREIGN PATENT DOCUMENTS

EP 1 755 109 2/2007
EP 1 808 684 7/2007
(Continued)

OTHER PUBLICATIONS

Authors: Dietz, Martin; Liljeryd, Lars; Kjorling, Kristofer; Kunz, Oliver. Spectral Band Replication, a Novel Approach in Audio Coding. Affiliations: Coding Technologies, Nuremberg,Germany ; Coding Technologies, Stockholm, Sweden(See document for exact affiliation information.) AES Convention:112 (Apr. 2002) Paper No. 5553.*

(Continued)

*Primary Examiner* — Paras D Shah
*Assistant Examiner* — Matthew Baker
(74) *Attorney, Agent, or Firm* — Dickinson Wright PLLC

(57) ABSTRACT

There is disclosed an encoding device capable of appropriately adjusting the dynamic range of spectrum inserted according to the technique for replacing a spectrum of a certain band with a spectrum of another band. The device includes a spectrum modification unit (112) which modifies a first spectrum S1(k) of the band 0≦k<FL in various ways to change the dynamic range so that a way of modification for obtaining an appropriate dynamic range is checked. The information concerning the modification is encoded and given to a multiplexing unit (115). By using a second spectrum S2(k) having a valid signal band 0≦k.

27 Claims, 29 Drawing Sheets

U.S. PATENT DOCUMENTS

| | | | | |
|---|---|---|---|---|
| 5,742,734 | A * | 4/1998 | DeJaco et al. | 704/226 |
| 5,983,172 | A * | 11/1999 | Takashima et al. | 704/203 |
| 6,006,108 | A * | 12/1999 | Black et al. | 455/553.1 |
| 6,097,824 | A * | 8/2000 | Lindemann et al. | 381/315 |
| 6,449,596 | B1 * | 9/2002 | Ejima | 704/501 |
| 6,680,972 | B1 * | 1/2004 | Liljeryd et al. | 375/240 |
| 6,708,145 | B1 * | 3/2004 | Liljeryd et al. | 704/200.1 |
| 6,795,805 | B1 * | 9/2004 | Bessette et al. | 704/223 |
| 6,807,524 | B1 * | 10/2004 | Bessette et al. | 704/200.1 |
| 6,978,010 | B1 * | 12/2005 | Short et al. | 379/388.03 |
| 7,283,955 | B2 * | 10/2007 | Liljeryd et al. | 704/219 |
| 7,318,035 | B2 * | 1/2008 | Andersen et al. | 704/500 |
| 7,430,506 | B2 * | 9/2008 | Nam et al. | 704/207 |
| 7,447,631 | B2 * | 11/2008 | Truman et al. | 704/230 |
| 7,469,206 | B2 * | 12/2008 | Kjorling et al. | 704/205 |
| 7,529,660 | B2 * | 5/2009 | Bessette et al. | 704/205 |
| 7,685,218 | B2 * | 3/2010 | McGrath | 708/313 |
| 8,082,156 | B2 * | 12/2011 | Shimada | 704/500 |
| RE43,189 | E * | 2/2012 | Liljeryd et al. | 704/200.1 |
| 8,121,850 | B2 * | 2/2012 | Yamanashi et al. | 704/501 |
| 2003/0088328 | A1 | 5/2003 | Nishio | |
| 2003/0088400 | A1 | 5/2003 | Nishio | |
| 2003/0088423 | A1 * | 5/2003 | Nishio et al. | 704/500 |
| 2003/0093271 | A1 | 5/2003 | Tsushima | |
| 2003/0187663 | A1 * | 10/2003 | Truman et al. | 704/500 |
| 2004/0028244 | A1 * | 2/2004 | Tsushima et al. | 381/98 |
| 2004/0078194 | A1 * | 4/2004 | Liljeryd et al. | 704/200.1 |
| 2004/0117177 | A1 * | 6/2004 | Kjorling et al. | 704/225 |
| 2005/0073986 | A1 * | 4/2005 | Kondo et al. | 370/343 |
| 2005/0149339 | A1 * | 7/2005 | Tanaka et al. | 704/500 |
| 2007/0088542 | A1 * | 4/2007 | Vos et al. | 704/219 |
| 2009/0157413 | A1 * | 6/2009 | Oshikiri | 704/501 |

FOREIGN PATENT DOCUMENTS

| | | |
|---|---|---|
| JP | 09090992 | 4/1997 |
| JP | 09153811 | 6/1997 |
| JP | 2000-206989 | 7/2000 |
| JP | 2001-521648 | 11/2001 |
| JP | 2003-108197 | 4/2003 |
| JP | 2003-216190 | 7/2003 |
| JP | 2003-228399 | 8/2003 |
| JP | 2004-102095 | 4/2004 |
| WO | 03/003350 | 1/2003 |
| WO | 2004/027368 | 4/2004 |

OTHER PUBLICATIONS

Bradley, M.J.; , "Digital Radio Mondiale: system and receivers," HF Radio Systems and Techniques, 2003. Ninth International Conference on (Conf. Publ. No. 493) , vol., No., pp. 198-202, Jun. 23-26, 2003 doi: 10.1049/cp:20030456 URL: http://ieeexplore.ieee.org/stamp/stamp.jsp?tp=&arnumber=1350448&isnumber=29689.*

Oshikiri, M.; Ehara, H.; Yoshida, K.; , "Efficient spectrum coding for super-wideband speech and its application to 7/10/15 kHz bandwidth scalable coders," Acoustics, Speech, and Signal Processing, 2004. Proceedings. (ICASSP '04). IEEE International Conference on , vol. 1, No., pp. I-481-4 vol. 1, May 17-21, 2004 doi: 10.1109/ICASSP.2004.1326027.*

Oshikiri, M.; Ehara, H.; Yoshida, K.; , "A scalable coder designed for 10-kHz bandwidth speech," Speech Coding, 2002, IEEE Workshop Proceedings. , vol., No., pp. 111-113, Oct. 6-9, 2002 doi: 10.1109/SCW.2002.1215741 URL: http://ieeexplore.ieee.org/stamp/stamp.jsp?tp=&arnumber=1215741&isnumber=27344.*

PCT International Search Report dated Sep. 6, 2005.

European Search Report dated Dec. 17, 2010.

M. Oshikiri, et al., "Scalable speech coding method in 7/10/15 kHz band using band enhancement techniques by pitch filtering," The 2004 Spring Meeting of the Acoustical Society of Japan, Mar. 2004, pp. 327-328 with partial English translation.

M. Oshikiri, et al., "Improvement of the super-wideband scalable coder using pitch filtering based spectrum coding," Sep. 2004, pp. 297-298 with partial English translation.

M. Oshikiri, et al., "A 10 kHz bandwidth scalable codec using adaptive selection VQ of time-frequency coefficients," 2003, pp. 239-240 with partial English translation.

Y. Nakatoh, et al., "Generation of Broadband Speech from Narrowband Speech Based on Linear Mapping," Nov. 2000, pp. 2246-2254 with partial English translation.

* cited by examiner

ENCODING DEVICE, DECODING DEVICE, AND METHOD THEREOF

TECHNICAL FIELD

The present invention relates to a coding apparatus and decoding apparatus that codes/decodes a speech signal, audio signal and the like, and methods thereof.

BACKGROUND ART

A speech coding technology that compresses a speech signal at a low bit rate is important for efficiently using a radio wave etc. in mobile communication. Further, in recent years, expectation for improvement of quality of communication speech has been increased, and it is desired to implement communication services with high realistic quality. Here, realistic quality means the sound environment surrounding the speaker (for example, BGM), and it is preferable that signals other than a speech signal such as audio can be coded with high quality.

There are schemes such as G726 and G729 defined in ITU-T (International Telecommunication Union Telecommunication Standardization Sector) for speech coding of coding speech signals. In these schemes, coding is carried out at 8 kbit/s to 32 kbit/s targeting a narrow band signal (300 Hz to 3.4 kHz). Though these schemes are capable of coding at a low bit rate, since the targeted narrow band signal is narrow up to a maximum of 3.4 kHz, this quality tends to lack realistic quality.

Further, in ITU-T and 3GPP (The 3rd Generation Partnership Project), there are standard schemes of speech coding with signal band of 50 Hz to 7 kHz (G.722, G.722.1, AMR-WB, and the like). Though these schemes are capable of coding a wideband speech signal at a bit rate of 6.6 kbit/s to 64 kbit/s, it is necessary to increase bit rates relatively for coding wideband speech with high quality. From the viewpoint of speech quality, wideband speech is high quality compared to narrow band speech, but it is difficult to say that this is sufficient for services requiring high realistic quality.

Typically, when maximum frequency of a signal is 10 to 15 kHz, realistic quality equivalent to FM radio quality can be obtained, and, when maximum frequency is 20 kHz, quality equivalent to CD can be obtained. Audio coding such as a layer 3 scheme or AAC scheme defined by MPEG (Moving Picture Expert Group) is suitable for a signal having such band. However, when these audio coding schemes are applied as a coding scheme for speech communication, it is necessary to set a high bit rate in order to code speech with good quality. There are also other problems such as a problem that a coding delay becomes substantial.

As a method of coding a signal with wide frequency band at a low bit rate with high quality, there is a technology for reducing overall bit rate by dividing the spectrum of an input signal into low frequency band and high frequency band to obtain two spectrums, duplicating the low frequency band spectrum and substituting the low frequency band spectrum for the high frequency band spectrum (using the low frequency band spectrum in place of the high frequency band spectrum) (for example, refer to Patent Document 1). In this technology, a large number of bits are allocated for coding of the low frequency band spectrum, and coding is performed with high quality, while on the other hand, the high frequency band spectrum duplicates the coded low frequency band spectrum as basic processing, and coding is performed with a small number of bits.

Further, as a technology similar to this technology, there are a technology of improving quality by performing approximation on band where coded bits cannot be sufficiently allocated using other predetermined partial band spectrum information (for example, refer to Patent Document 2), and a technology of duplicating a low frequency band spectrum of a narrow band signal as a high frequency band spectrum as basic processing in order to extend band of a narrow band signal to a wideband signal without additional information (for example, refer to Patent Document 3).

In either technology, another band spectrum is duplicated for band where it is wished to compensate a spectrum, and after gain is adjusted to smooth the spectrum envelope, this duplicated spectrum is inserted.

Patent Document 1: Japanese Patent Publication Laid-open No. 2001-521648.

Patent Document 2: Japanese Patent Application Laid-open No. HEI9-153811.

Patent Document 3: Japanese Patent Application Laid-open No. HEI9-90992.

DISCLOSURE OF INVENTION

Problems to be Solved by the Invention

However, in a spectrum of a speech signal or audio signal, the phenomena can be often seen where the dynamic range (ratio between the maximum value and minimum value of the absolute value of the spectral amplitude (absolute amplitude)) of the low frequency band spectrum is larger than the dynamic range of the high frequency band spectrum. FIG. 1 illustrates this phenomena and shows an example of a spectrum for an audio signal. This spectrum is a log spectrum in the case where an audio signal with sampling frequency of 32 kHz is subjected to frequency analysis for 30 ms.

As shown in this drawing, a low frequency band spectrum with frequency of 0 to 8000 Hz has strong peak performance (a large number of sharp peaks exist), and the dynamic range of the spectrum at this band becomes large. On the other hand, the dynamic range of the high frequency band spectrum with frequency of 8000 to 15000 Hz becomes small. With the conventional method of duplicating the low frequency band spectrum as a high frequency band spectrum, even if gain adjustment of the high frequency band spectrum is performed on a signal having such a spectrum characteristic, unnecessary peak shapes appear in the high frequency band spectrum as shown below.

FIG. 2 shows the entire band spectrum in the case where a high frequency band spectrum (10000 to 16000 Hz) is obtained by duplicating a low frequency band spectrum (1000 to 7000 Hz) of the spectrum shown in FIG. 1 and adjusting energy.

When the above-described processing is carried out, as shown in this drawing, unnecessary peak shapes appear in band R1 of 10000 Hz or above. These peaks are not found in the original high frequency band spectrum. In a decoded signal obtained by converting this spectrum to a time domain, a problem arises that noise that sounds like a bell ringing occurs and the subjective quality therefore deteriorates. In this way, with technology where a spectrum of another band is substituted for a spectrum of given band, it is necessary to appropriately adjust the dynamic range of the inserted spectrum.

It is therefore an object of the present invention to provide a coding apparatus, decoding apparatus, and methods for these apparatuses capable of appropriately adjusting dynamic range of an inserted spectrum and increasing the subjective quality of the decoded signal in a technology for substituting (replacing) a spectrum of another band for a spectrum of given band.

Means for Solving the Problem

A coding apparatus of the present invention adopts a configuration having: a coding section that codes a high frequency band spectrum of an input signal; and a limiting section that generates a second low frequency band spectrum in which amplitude of a first low frequency band spectrum that is a decoded signal of a coded low frequency band spectrum of the inputted signal is uniformly limited, wherein the coding section codes the high frequency band spectrum based on the second low frequency band spectrum.

A decoding apparatus of the present invention adopts a configuration having: a converting section that generates a first low frequency band spectrum in which a decoded signal of code of a low frequency band spectrum included in code generated in the coding apparatus is converted to a signal of a frequency domain; a decoding section that decodes code of a high frequency band spectrum included in the code generated in the coding apparatus; and a limiting section that generates a second low frequency band spectrum in which amplitude of the first low frequency band spectrum is uniformly limited according to spectrum modification information included in the code generated in the coding apparatus, wherein, the decoding section decodes the high frequency band spectrum based on the second low frequency band spectrum.

Further, the decoding apparatus of the present invention adopts a configuration having: a converting section that generates a first low frequency band spectrum in which a decoded signal of code of a low frequency band spectrum generated in the coding apparatus is converted to a signal of a frequency domain; a decoding section that decodes code of a high frequency band spectrum included in the code generated in the coding apparatus; and a limiting section that generates a second low frequency band spectrum in which amplitude of the first low frequency band spectrum is uniformly limited, wherein: the limiting section estimates information about the way of limiting based on the first low frequency band spectrum and generates the second low frequency band spectrum using the estimated information; and the decoding section decodes the high frequency band spectrum based on the second low frequency band spectrum.

Advantageous Effect of the Invention

According to the present invention, in a technology of substituting a spectrum of another band for a spectrum of given band, it is possible to appropriately adjust the dynamic range of the inserted spectrum and improve the subjective quality of the decoded signal.

BEST MODE FOR CARRYING OUT THE INVENTION

Embodiments of the present invention will be explained below in detail with reference to the accompanying drawings.

Embodiment 1

Figure 1:
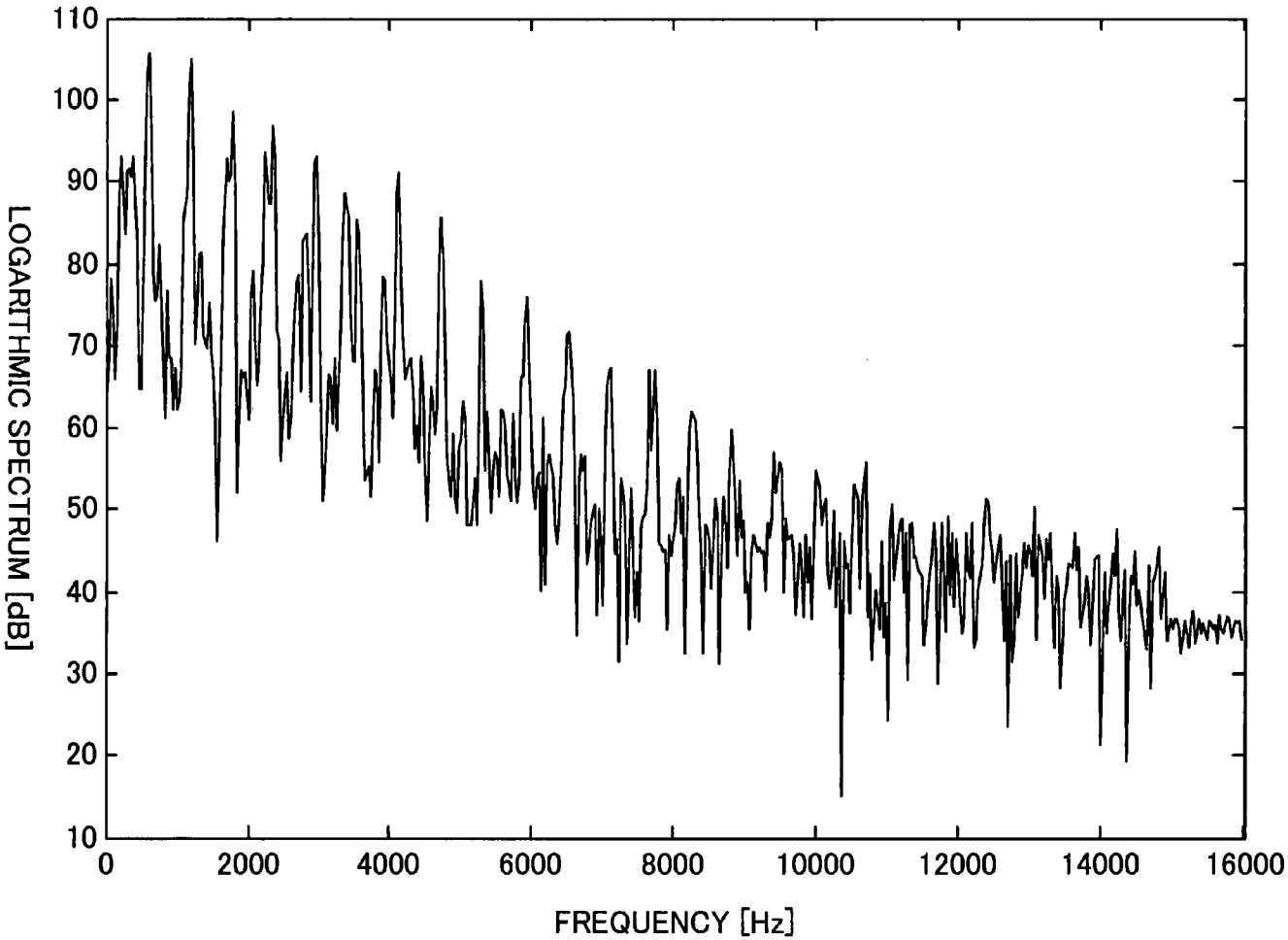
FIG. 1 shows an example of an audio signal spectrum.
Figure 2:
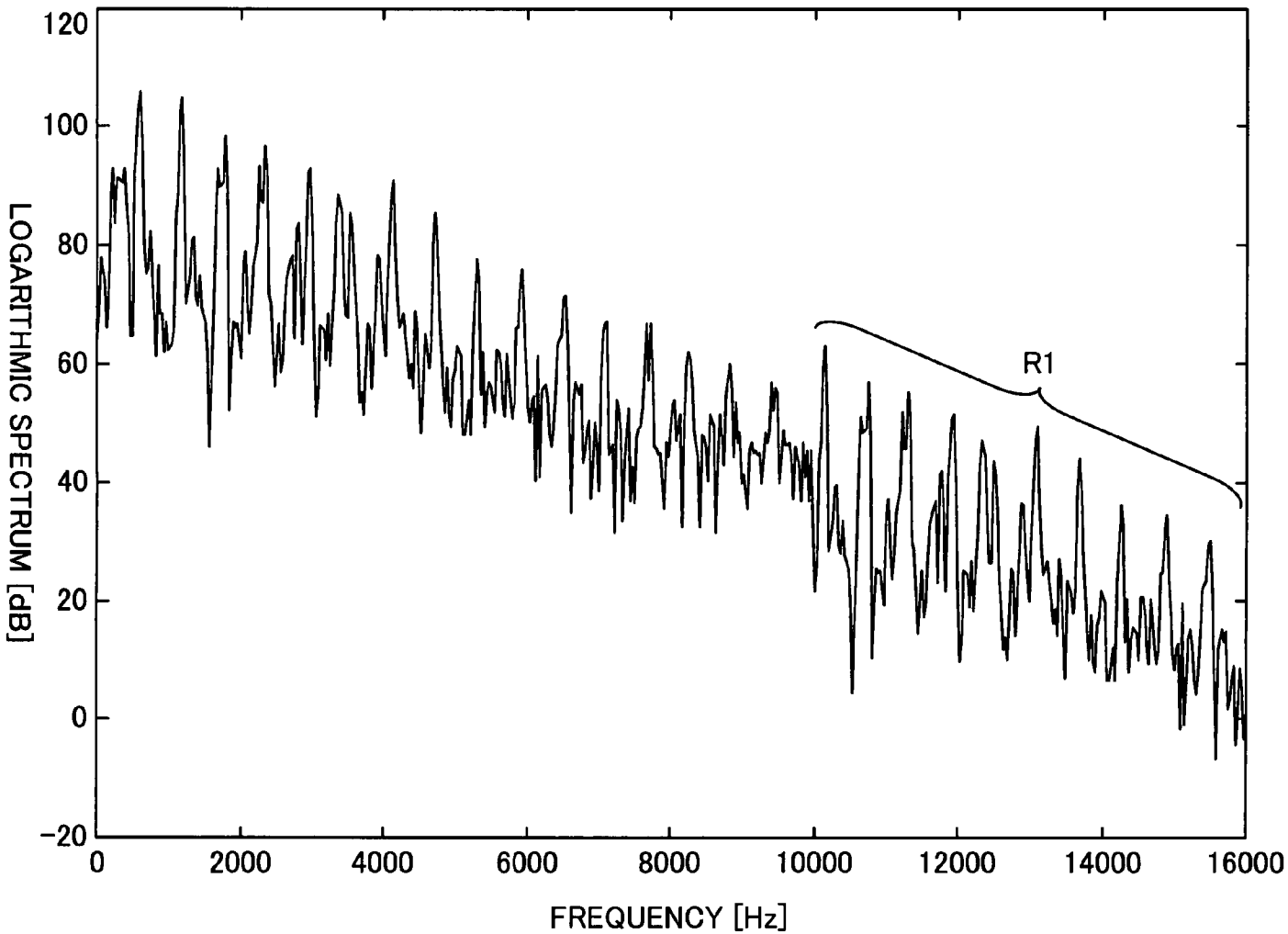
FIG. 2 shows the entire band spectrum in the case of obtaining a high frequency band spectrum by duplicating a low frequency band spectrum and adjusting energy.
Figure 3:
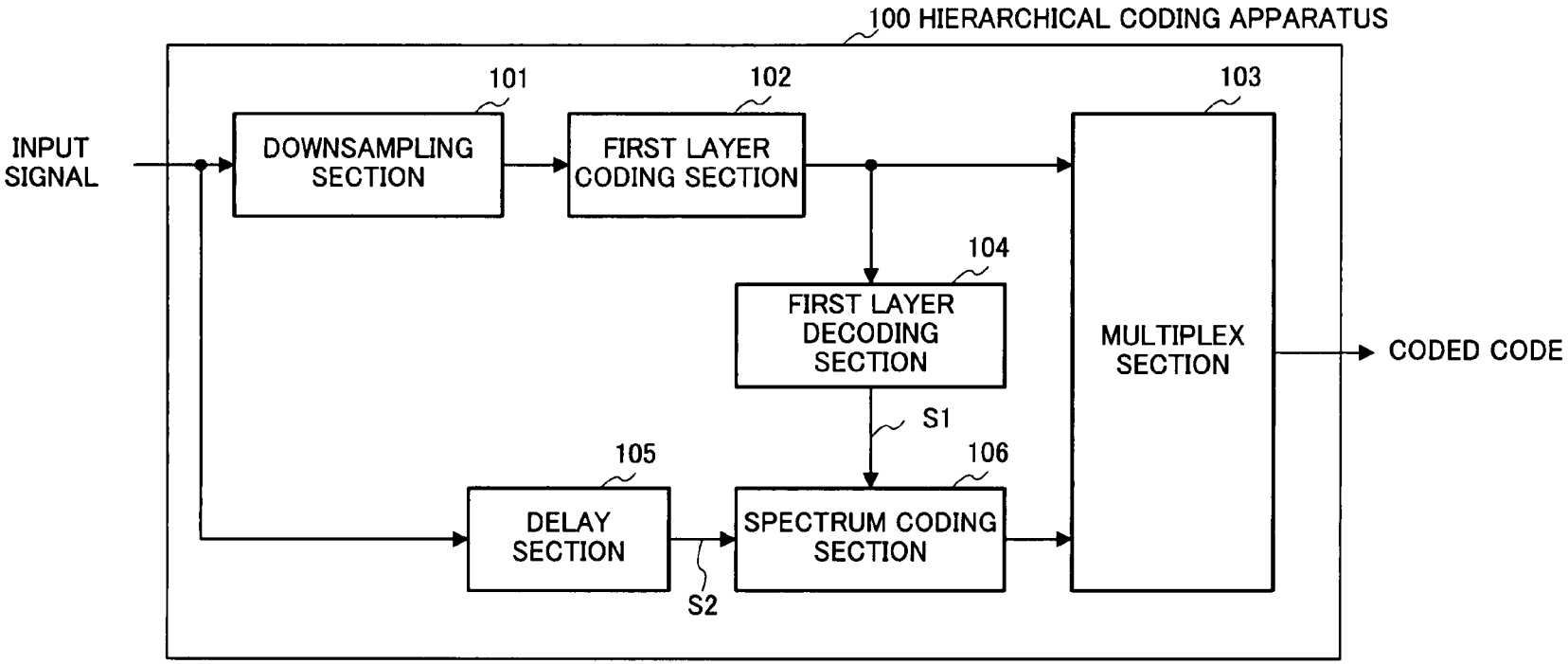
FIG. 3 is a block diagram showing the main configuration of the coding apparatus according to Embodiment 1.

FIG. 3 is a block diagram showing the main configuration of hierarchical coding apparatus 100 according to Embodiment 1 of the present invention. Here, a case will be explained as an example where coding information has a hierarchical structure made up of a plurality of layers, that is, hierarchical coding (scalable coding) is performed.

Each part of hierarchical coding apparatus 100 carries out the following operation in accordance with input of the signal.

Down-sampling section 101 generates a signal with a low sampling rate from the input signal and supplies this signal to first layer coding section 102. First layer coding section 102 codes the signal outputted from down-sampling section 101. Coded code obtained at first layer coding section 102 is supplied to multiplex section 103 and to first layer decoding section 104. First layer decoding section 104 then generates first layer decoding signal S1 from the coded code outputted from first layer coding section 102.

On the other hand, delay section 105 gives a delay of a predetermined length to the input signal. This delay is for correcting a time delay occurring at down-sampling section 101, first layer coding section 102 and first layer decoding section 104. Spectrum coding section 106 performs spectrum coding on input signal S2 delayed by a predetermined time and outputted from delay section 105, using first layer decoding signal S1 generated at first layer decoding section 104, and outputs the generated coded code to multiplex section 103.

Multiplex section 103 then multiplexes the coded code obtained at first layer coding section 102 with the coded code obtained at spectrum coding section 106 and outputs the result to outside of coding apparatus 100 as output coded code.

Figure 4:
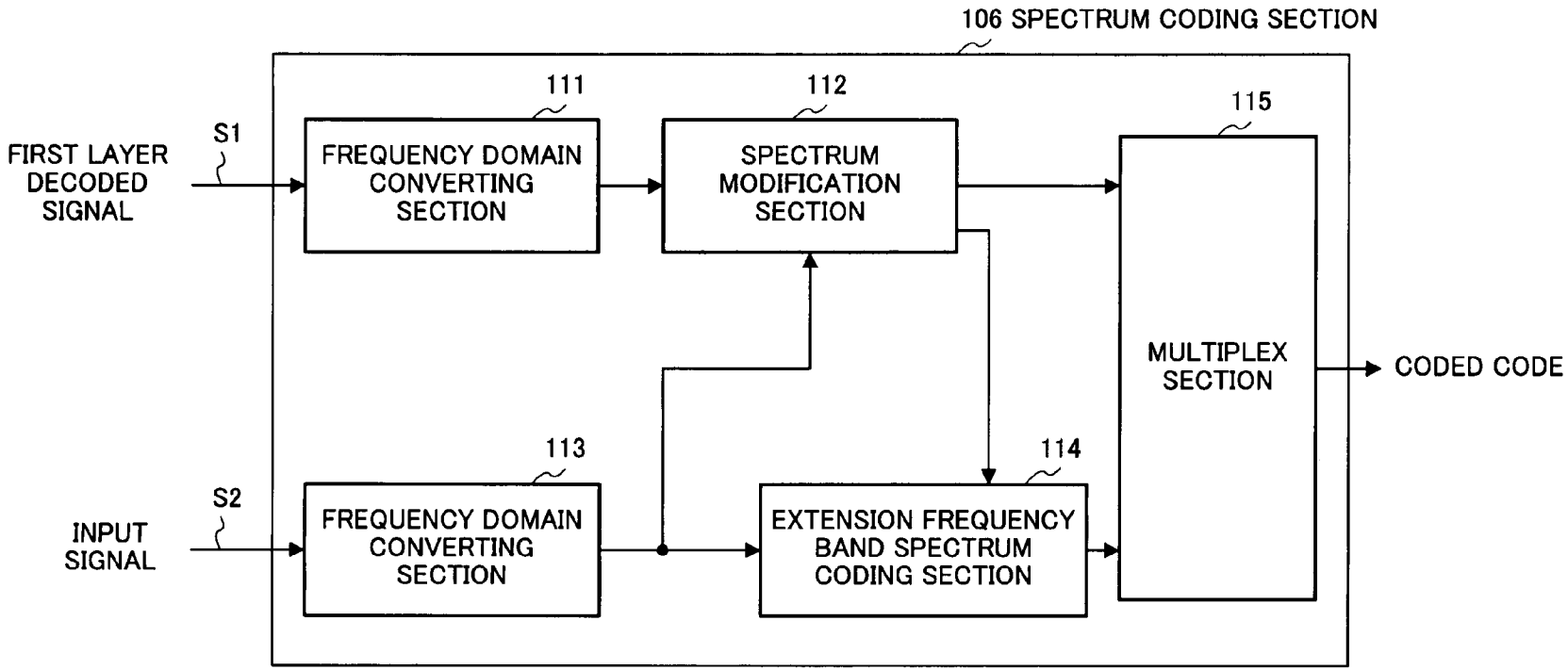
FIG. 4 is a block diagram showing the main configuration of the internal part of a spectrum coding section according to Embodiment 1.

FIG. 4 is a block diagram showing the main configuration of the internal part of the above-described spectrum coding section 106.

This spectrum coding section 106 is mainly configured with frequency domain converting section 111, spectrum modification section 112, frequency domain converting section 113, extension frequency band spectrum coding section 114 and multiplex section 115.

Spectrum coding section 106 receives first signal S1 with valid signal band of $0 \leqq k < FL$ (where k is the frequency) from first layer decoding section 104, and second signal S2 with valid signal band of $0 \leqq k < FH$ (where $FL < FH$) from delay section 105. Spectrum coding section 106 estimates a spectrum with band of $FL \leqq k < FH$ of second signal S2 using a spectrum with band of $0 \leqq k < FL$ of signal S1, and codes and outputs this estimation information.

Frequency domain converting section 111 performs frequency conversion on inputted first signal S1 and calculates first spectrum S1($k$) that is a low frequency band spectrum. On the other hand, frequency domain converting section 113 performs frequency conversion on inputted second signal S2, and calculates wideband second spectrum S2($k$). Here, Discrete Fourier Transform (DFT) Discrete Cosine Transform (DCT), Modified Discrete Cosine Transform (MDCT), or the like, is applied as the method of frequency conversion. Further, S1($k$) is a spectrum with frequency k of the first spectrum, and S2($k$) is a spectrum with frequency k of the second spectrum.

Spectrum modification section 112 investigates a way of modifying so as to obtain an appropriate dynamic range by changing the dynamic range of the first spectrum by variously modifying first spectrum S1($k$). Information about this modification (modification information) is coded and supplied to multiplex section 115. This spectrum modification processing is described in detail later. Further, spectrum modification section 112 outputs first spectrum S1($k$) having an appropriate dynamic range to extension frequency band spectrum coding section 114.

Extension frequency band spectrum coding section 114 estimates a spectrum (extension frequency band spectrum) which should be included in high frequency band ($FL \leqq k < FH$) of first spectrum S1($k$) using second spectrum S2($k$) as a reference signal, codes information about this estimated spectrum and supplies this information to multiplex section 115. Here, estimation of an extension frequency band spectrum is carried out based on first spectrum after modification S1'(k).

Multiplex section 115 then multiplexes and outputs coded code of the modification information outputted from spectrum modification section 112 and coded code of estimation information about the extension frequency band spectrum outputted from extension frequency band spectrum coding section 114.

Figure 5:
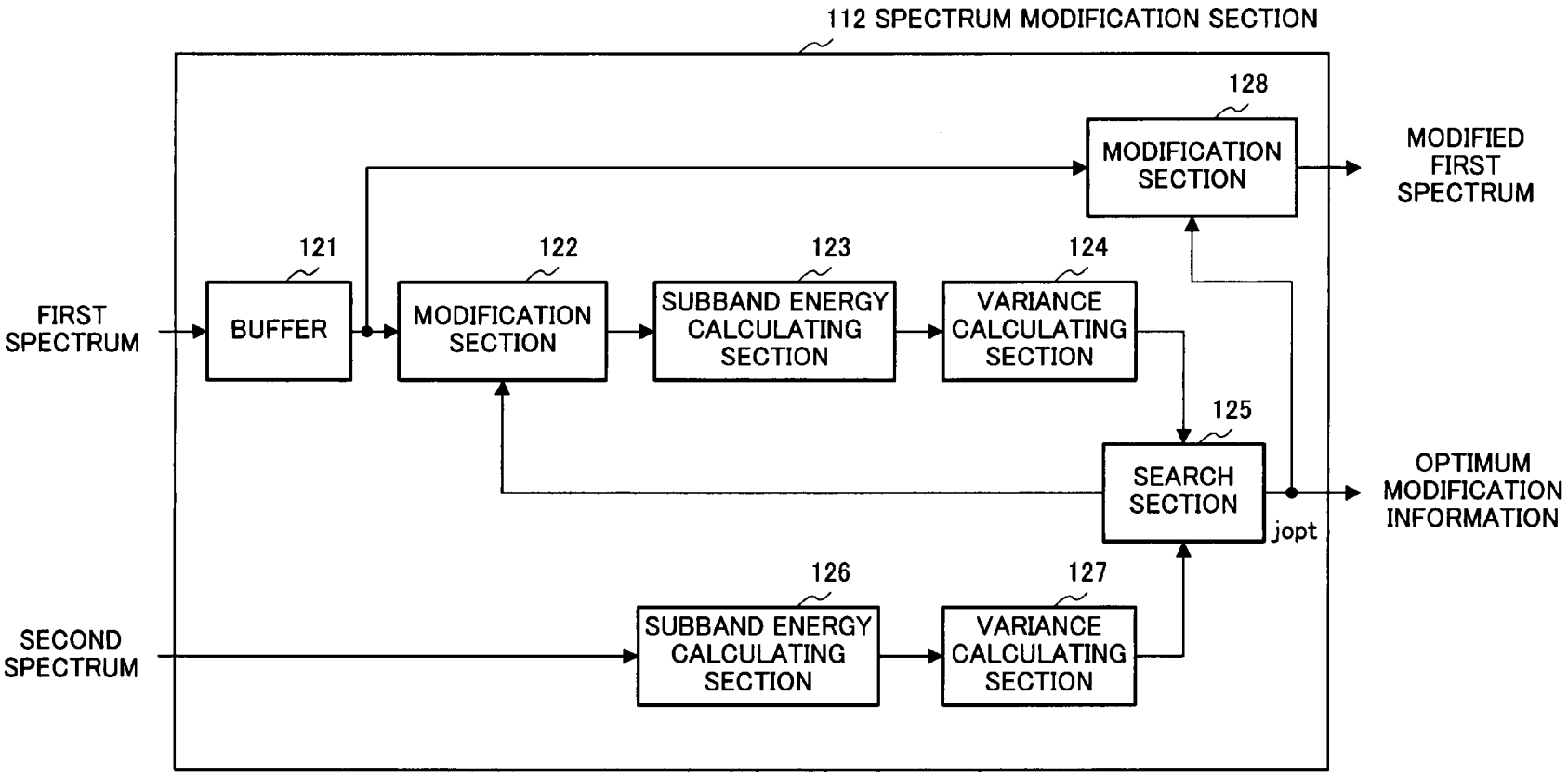
FIG. 5 is a block diagram showing the main configuration of the internal part of a spectrum modification section according to Embodiment 1.

FIG. 5 is a block diagram showing the main configuration of internal part of the above-described spectrum modification section 112.

Spectrum modification section 112 applies the modification so that the dynamic range of first spectrum S1($k$) becomes the closest to the dynamic range of the high frequency band spectrum ($FL \leqq k < FH$) of second spectrum S2($k$). The modification information at this time is then coded and outputted.

Buffer 121 temporarily stores the inputted first spectrum S1($k$), and supplies first spectrum S1($k$) to modification section 122 as necessary.

Modification section 122 then variously modifies first spectrum S1($k$) in accordance with the procedure described below so as to generate modified first spectrum S1'(j, k), and this is supplied to subband energy calculating section 123. Here, j is an index for identifying each modification processing.

Subband energy calculating section 123 then divides the frequency band of modified first spectrum S'(j, k) into a plurality of subbands, and obtains subband energy (subband energy) of a predetermined range. For example, when a range for obtaining subband energy is determined as $F1L \leqq k < F1H$, the subband width BSW in the case where this bandwidth is divided into N, is expressed by the following (equation 1).

$$BWS=(F1H-F1L+1)/N \quad \text{(Equation 1)}$$

As a result, minimum frequency F1L(n) of the nth subband and maximum frequency F1H(n) are expressed respectively by (equation 2) and (equation 3).

$$F1L(n)=F1L+n\cdot BWS \quad \text{(Equation 2)}$$

$$F1H(n)=F1L+(n+1)\cdot BWS-1 \quad \text{(Equation 3)}$$

where n is a value from 0 to N−1.

At this time, subband energy P1($j$, $n$) is calculated as shown in the following (Equation 4).

$$P1(j,n)=\frac{\sum_{k=F1L(n)}^{F1H(n)} S1'(j,k)^2}{BWS} \quad \text{(Equation 4)}$$

Further, this may also be obtained as an average value of a spectrum included in the subband as shown in (Equation 5) below.

$$P1(j,n)=\sqrt{\frac{\sum_{k=F1L(n)}^{F1H(n)} S1'(j,k)^2}{BWS}} \quad \text{(Equation 5)}$$

Subband energy P1($j$, $n$) obtained in this way is then supplied to variance calculating section 124.

Variance calculating section 124 calculates variance $\sigma 1^2(j)$ in accordance with (equation 6) below in order to indicate the degree of variation of subband energy P1($j$, $n$).

$$\sigma 1^2(j)=\sum_{n=0}^{N-1}(P1(j,n)-P1\text{mean}(j))^2 \quad \text{(Equation 6)}$$

Here, P1mean(j) indicates the average value of subband energy P1($j$, $n$) and is calculated from (Equation 7) below.

$$P1\text{mean}(j)=\frac{\sum_{n=0}^{N-1} P1(j,n)}{N} \quad \text{(Equation 7)}$$

Variance $\sigma 1^2(j)$ indicating the degree of variation of subband energy in the modification information j calculated in this way is then supplied to search section 125.

As with a series of processing carried out at subband energy calculating section 123 and variance calculating section 124, subband energy calculating section 126 and variance calculating section 127 calculate variance $\sigma 2^2$ indicating the degree of variation of subband energy for the inputted second spectrum S2($k$). However, the processing of subband energy calculating section 126 and variance calculating section 127 differ from the above processing with regard to the following points. Namely, the predetermined range for calculating subband energy of second spectrum S2($k$) is determined as F2L≦k<F2H. Here, since it is necessary for the dynamic range of the first spectrum to be close to the dynamic range of the high frequency band spectrum of the second spectrum, F2L is set so as to satisfy the conditions of FL≦F2L<F2H. Further, it is not necessary for the number of subbands for the second spectrum to correspond to the number of subbands N of the first spectrum. However, the number of subbands of the second spectrum is set so that the subband width of the first spectrum substantially corresponds to the subband width of the second spectrum.

Search section 125 determines variance $\sigma 1^2(j)$ of the subband of the first spectrum for the case where variance $\sigma 1^2(j)$ of the subband of the first spectrum is the closet to variance $\sigma 2^2$ of the subband of the second spectrum, by searching. Specifically, search section 125 calculates variance $\sigma 1^2(j)$ of the subband of the first spectrum for all the modification candidates of 0≦j<J, compares the calculated values with variance $\sigma 2^2$ of the subband of the second spectrum, determines a value of j for the case where both are the closet (optimum modification information jopt), and outputs jopt to outside of spectrum modification section 112 and modification section 128.

Modification section 128 generates a modified first spectrum S' (jopt, k) corresponding to this optimum modification information jopt, and outputs this to outside of spectrum modification section 112. Optimum modification information jopt is transmitted to multiplex section 115, and modified first spectrum S1' (jopt, k) is transmitted to extension frequency band spectrum coding section 114.

Figure 6:
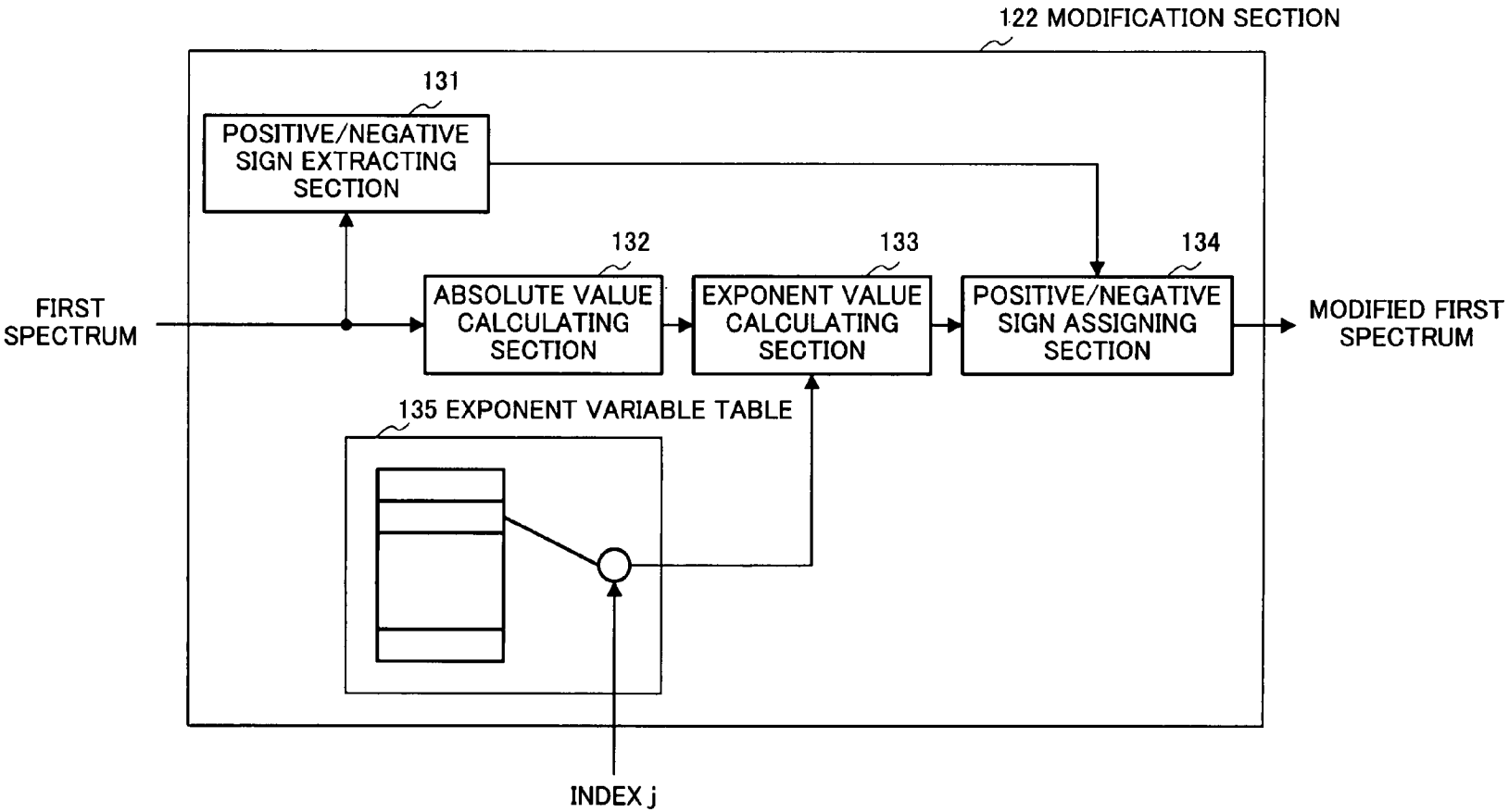
FIG. 6 is a block diagram showing the main configuration of the internal part of a modification section according to Embodiment 1.

FIG. 6 is a block diagram showing the main configuration of the internal part of the above-described modification section 122. The configuration of the internal part of modification section 128 is basically the same as modification section 122.

Positive/negative sign extracting section 131 obtains coding information sign(k) for each subband of the first spectrum, and outputs the result to positive/negative sign assigning section 134.

Absolute value calculating section 132 calculates an absolute value of amplitude for each subband of the first spectrum and supplies this value to exponent value calculating section 133.

Exponent variable table 135 records exponent variable α(j) to be used in modification of the first spectrum. A value corresponding to j out of the variables included in this table is outputted from exponent variable table 135. Specifically, in exponent variable table 135, candidates for exponent variables, for example, four exponent variables α(j)={1.0, 0.8, 0.6, 0.4} are recorded, and one exponent variable α(j) is selected based on index j indicated by search section 125, and supplied to exponent value calculating section 133.

Exponent value calculating section 133 calculates an exponent value of a spectrum (absolute value) outputted from absolute value calculating section 132, that is, a value in which an absolute value of amplitude for each subband is raised to the power of α(j) using the exponent variable outputted from exponent variable table 135.

Positive/negative sign assigning section 134 assigns coded information sign(k) obtained in advance at positive/negative sign extracting section 131 to the exponent value outputted from exponent value calculating section 133, and outputs the result as modified first spectrum S1'(j, k).

Modified first spectrum S1'(j, k) outputted from modification section 122 is expressed as shown in (Equation 8) below.

$$S1'(j,k)=\text{sign}(k)\cdot|S1(k)|^{\alpha(j)} \quad \text{(Equation 8)}$$

Figure 7:
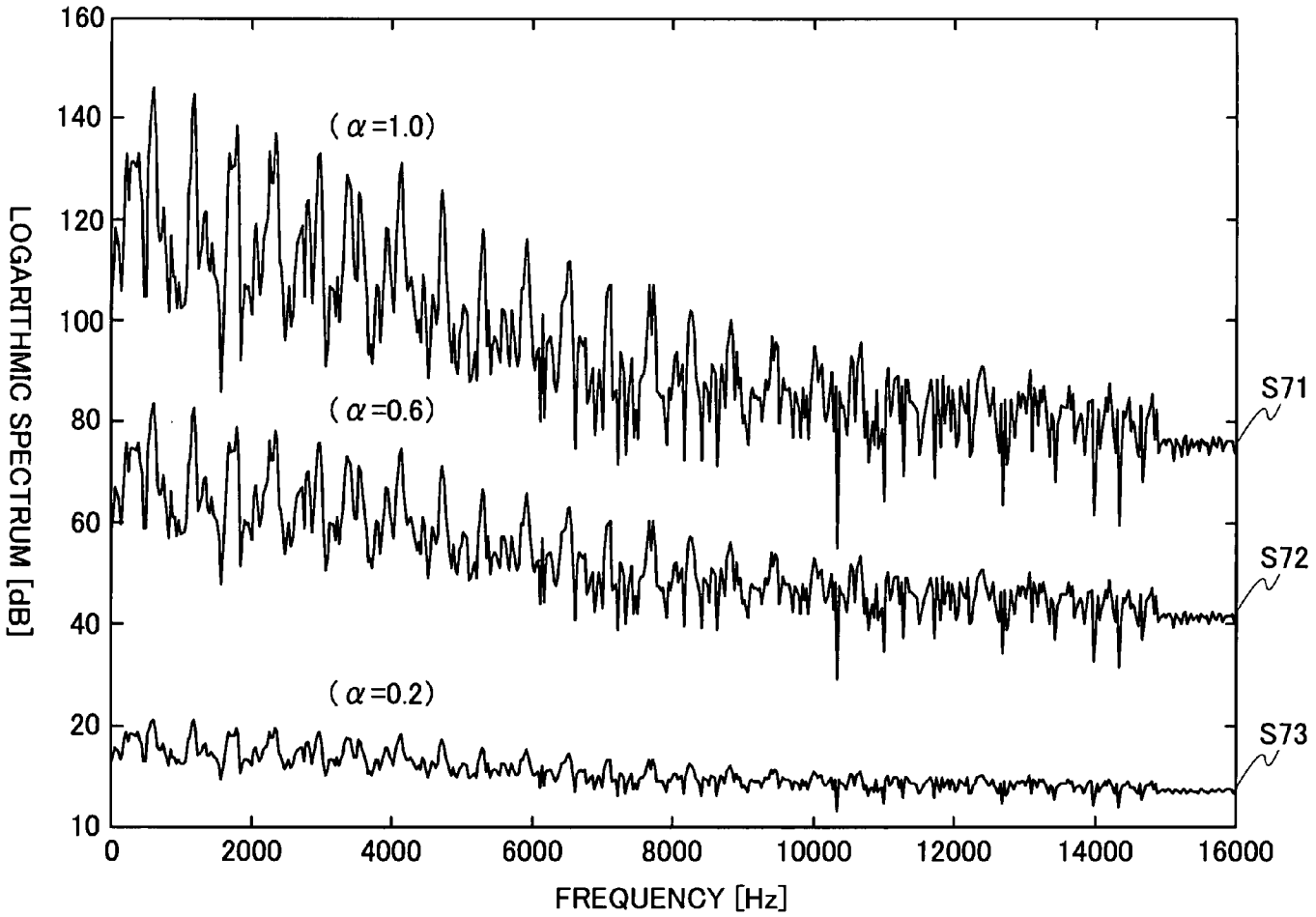
FIG. 7 shows an example of a modified spectrum obtained by the modification section according to Embodiment 1.

FIG. 7 shows an example of a modified spectrum obtained by the modification section 122 (or modification section 128).

Here, a case of exponent variable α(j)={1.0, 0.6, 0.2} is explained as an example. Further, here, in order to simplify comparison of each spectrum, spectrum S71 for the case of α(j)=1.0 is shifted up by 40 dB, and spectrum S72 for the case of α(j)=0.6 is shifted up by just 20 dB. From this drawing, it can be understood that it is possible to change the dynamic range of the spectrum according to exponent variable α(j).

As described above, according to the coding apparatus (spectrum coding section 106) of this embodiment, the high frequency band (FL≦k<FH) of the second spectrum obtained from a second signal (0≦k<FH) is estimated using the first spectrum obtained from a first signal (0≦k<FL), and, when the estimation information is coded, the above-described estimation is carried out after applying modification to the first spectrum without using the first spectrum as is. At this time, information (modification information) indicating how the modification has been performed is coded together and transmitted to the decoding side.

The specific method of applying modification to the first spectrum is to divide the first spectrum into subbands, obtain average of absolute amplitude of the spectrum (subband average amplitude) included in each subband, and modify the first spectrum so that variance obtained by performing statistical processing on these subband average amplitudes becomes the closet to variance of average amplitude of the subband obtained in the similar way from the spectrum of the high frequency band of the second spectrum. Namely, the first spectrum is modified so that the average deviation of the absolute amplitude of the first spectrum and the average deviation of the absolute amplitude of the high frequency band spectrum of the second spectrum have the similar value. Further, modification information indicating this specific modification method is coded. It is also possible to use energy of the spectrum included in each subband instead of the average amplitude of the subband.

Further detail of the specific modification method is to raise the spectrum of the first spectrum to the power of a ($0 \leqq \alpha \leqq 1$) and control variation (deviation) in the absolute amplitude of the spectrum within the subband. Information about used a is transmitted to the decoding side.

By adopting the above-described configuration, even in the case where the dynamic range of the first spectrum is substantially different from the dynamic range of the high frequency band of the second spectrum, it is possible to appropriately adjust the dynamic range of the estimated spectrum and improve the subjective quality of the decoded signal.

Further, in the above configuration, by raising the entire first spectrum to the power of $\alpha$ ($0 \leqq \alpha \leqq 1$), limitation is uniformly applied to the amplitude of the spectrum. As a result, it is possible to blunt sharp (steep) peaks. Further, for example, in the case of carrying out modification by simply cutting the peaks of a predetermined value or more, the spectrum may be discontinuous and generate a strange noise. However, by adopting the above-described configuration, it is possible to keep the spectrum smooth and prevent the occurrence of a strange noise.

In this embodiment, a case has been described as an example where variance is used as an index indicating the degree of variation (deviation) of the absolute amplitude of the spectrum, but this is by no means limiting, and, another index such as standard deviation, for example, may be also applied.

In this embodiment, a case has been described as an example where an exponential function is used in modification section 122 (or modification section 128) within coding apparatus 100, but it is also possible to use the method shown below.

Figure 8:
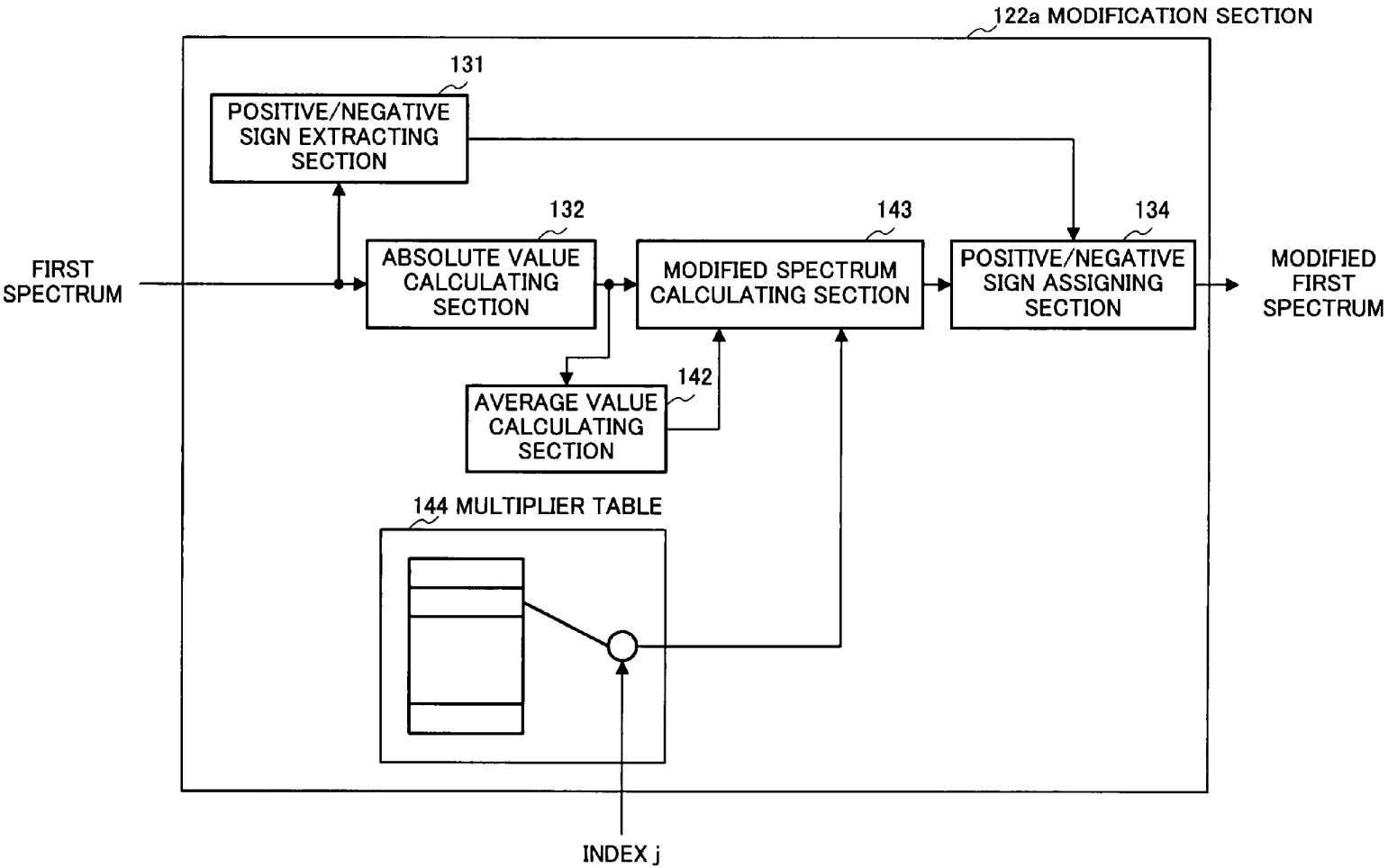
FIG. 8 is a block diagram showing a configuration of another variation of the modification section according to Embodiment 1.

FIG. 8 is a block diagram showing a configuration of another variation (modification section 122*a*) of the modification section. Components that are identical with modification section 122 (or modification section 128) will be assigned the same reference numerals without further explanations.

At the above-described modification section 122 (or modification section 128), the amount of calculation tends to increase since the exponential function is used. Therefore, increase of the amount of calculation is avoided by changing the dynamic range of the spectrum without using the exponential function.

Absolute value calculating section 132 calculates an absolute value for each spectrum of inputted first spectrum S1(*k*) and outputs the result to average value calculating section 142 and modified spectrum calculating section 143. Average value calculating section 142 calculates average value S1mean of the absolute value of the spectrum in accordance with the following (Equation 9).

$$S1\text{mean} = \sum_{k=0}^{FL-1} |S1(k)| \qquad \text{(Equation 9)}$$

Candidates for multipliers for use at modified spectrum calculating section 143 are recorded in multiplier table 144, and one multiplier is selected based on the index indicated by search section 125 and is outputted to modified spectrum calculating section 143. Here, it is assumed that four candidates for multipliers g(j)={1.0, 0.9, 0.8, 0.7} are recorded in the multiplier table.

Modified spectrum calculating section 143 calculates the absolute value of modified spectrum S1'(k) in accordance with the following (Equation 10) using the absolute value of the first spectrum outputted from absolute value calculating section 132 and multiplier g(j) outputted from multiplier table 144, and outputs the result to positive/negative sign assigning section 134.

$$|S1'(j,k)| = g(j)\cdot|S1(k)| + (1-g(j))\cdot S1\text{mean} \qquad \text{(Equation 10)}$$

Positive/negative sign assigning section 134 assigns coded information sign(k) obtained at positive/negative sign extracting section 131 to the absolute value of modified spectrum S1'(k) outputted from modified spectrum calculating section 143, and generates and outputs final modified spectrum S1'(k) expressed by the following (Equation 11).

$$S1'(j,k) = \text{sign}(k)\cdot|S1'(j,k)| \qquad \text{(Equation 11)}$$

Further, in this embodiment, a case has been described as an example where a modification section is provided with positive/negative sign extracting section, absolute value calculating section, and positive/negative sign assigning section, but these configurations are not necessary when the inputted spectrum is always positive.

Next, the configuration of hierarchical decoding apparatus 150 capable of decoding the coded code generated at coding apparatus 100 will be described in detail.

Figure 9:
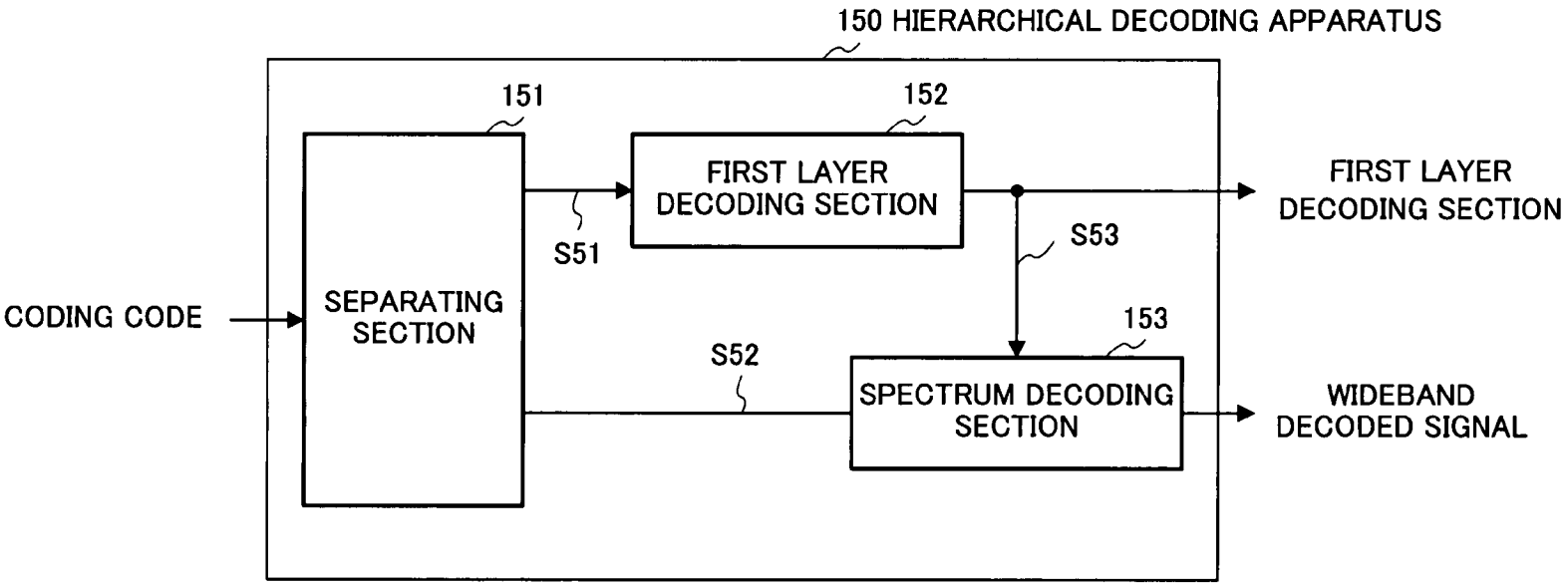
FIG. 9 is a block diagram showing the main configuration of a hierarchical decoding apparatus according to Embodiment 1.

FIG. 9 is a block diagram showing the main configuration of hierarchical decoding apparatus 150 according to this embodiment.

Separating section 151 implements separating processing on the inputted coded code and generates coded code S51 for first layer decoding section 152 and coded code S52 for spectrum decoding section 153. First layer decoding section 152 decodes a decoded signal with signal band of $0 \leqq k < FL$ using coded code obtained at separating section 151, and this decoded signal S53 is supplied to spectrum decoding section 153. Further, the output of first layer decoding section 152 is also connected to an output terminal of decoding apparatus 150. By this means, when it is necessary to output the first layer decoded signal generated at first layer decoding section 152, the signal can be outputted via this output terminal.

Spectrum decoding section 153 is provided with coded code S52 separated at separating section 151 and first layer decoding signal S53 outputted from first layer decoding section 152. Spectrum decoding section 153 carries out the following spectrum decoding, and generates and outputs a wideband decoding signal with signal band of $0 \leqq k < FH$. At spectrum decoding section 153, first layer decoding signal S53 supplied from first layer decoding section 152 is regarded as a first signal, and processing is carried out.

Figure 10:
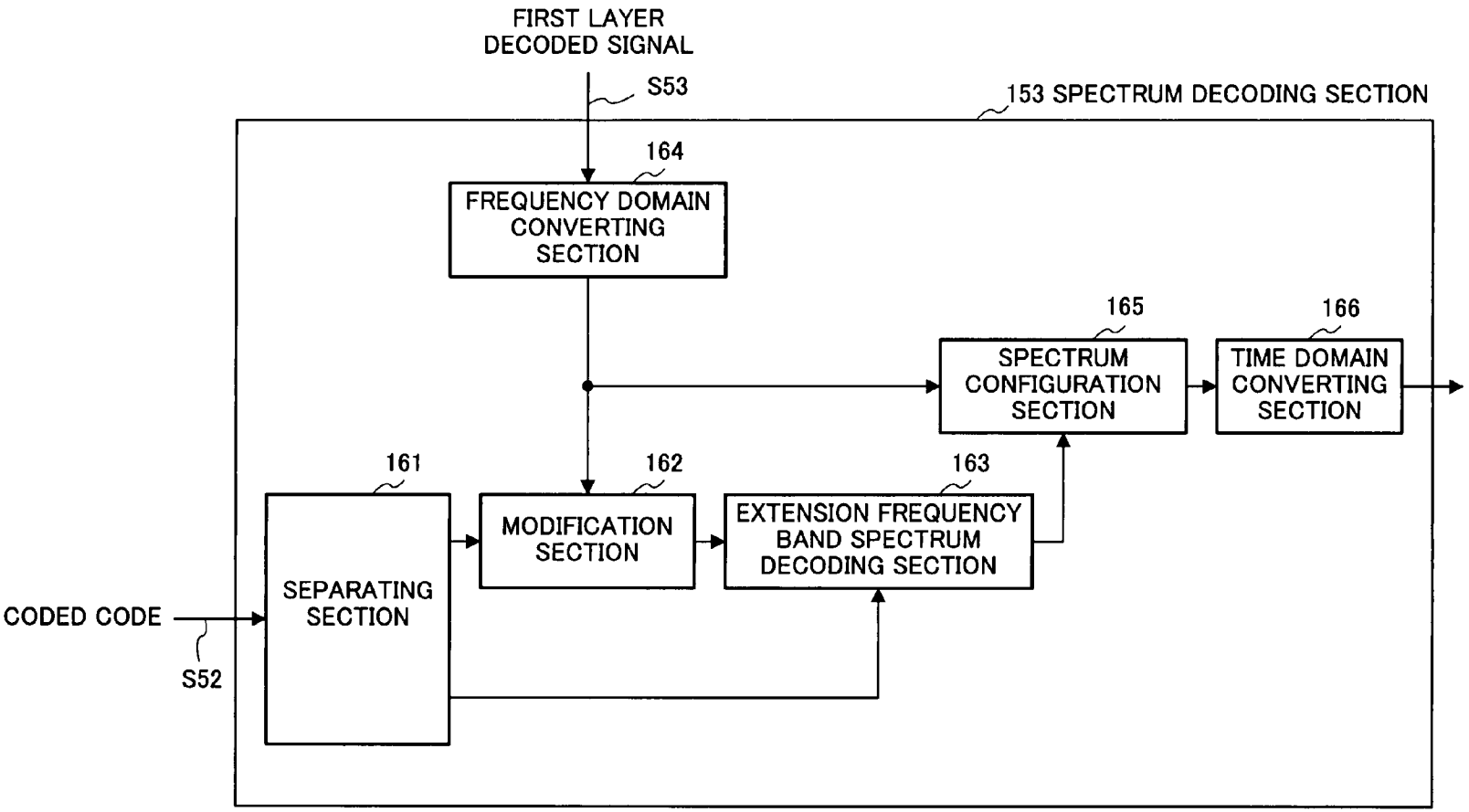
FIG. 10 is a block diagram showing the main configuration of the internal part of a spectrum decoding section according to Embodiment 1.

FIG. 10 is a block diagram showing the main configuration of the internal part of spectrum decoding section 153.

Coded code S52 and first layer decoded signal S53 (a first signal with valid frequency band of $0 \leqq k < FL$) are inputted to spectrum decoding section 153.

Separating section 161 then separates modification information and extension frequency band spectrum coded information generated at spectrum modification section 112 of the above-described coding side, from inputted coded code S52, and outputs modification information to modification section 162 and extension frequency band spectrum coded information to extension frequency band spectrum generating section 163.

Frequency domain converting section 164 carries out frequency conversion on first layer decoding signal S53 that is an inputted time domain signal and calculates first spectrum S1($k$). Discrete Fourier Transform (DFT), Discrete Cosine Transform (DCT), Modified Discrete Cosine Transform (MDCT), or the like is used as the method of frequency conversion.

Modification section 162 applies modification to first spectrum S1($k$) supplied from frequency domain converting section 164 based on the modification information supplied from separating section 161 and generates modified first spectrum S1'(k). The internal configuration of modification section 162 is the same as modification section 122 (refer to FIG. 6) of the coding side already described, and explanations will be therefore omitted.

Extension frequency band spectrum generating section 163 generates estimation value S2"(k) for a second spectrum which should be included in extension frequency band of FL≦k<FH of first spectrum S1($k$) using first spectrum after modification S1'(k) and supplies estimation value S2"(k) of the second spectrum to spectrum configuration section 165.

Spectrum configuration section 165 then integrates first spectrum S1($k$) supplied from frequency domain converting section 164 and estimation value S2"(k) of the second spectrum supplied from extension frequency band spectrum generating section 163, and generates decoded spectrum S3($k$). This decoded spectrum S3($k$) is expressed by the following (Equation 12).

$$S3(k) = \begin{cases} S1(k) & (0 \le k < FL) \\ S''2(k) & (FL \le k < FH) \end{cases} \quad \text{(Equation 12)}$$

This decoded spectrum S3($k$) is supplied to time domain converting section 166.

After decoded spectrum S3($k$) is converted to a signal of the time domain, time domain converting section 166 carries out appropriate processing such as windowing and overlapped addition as necessary so as to avoid discontinuities occurring between frames, and outputs a final decoding signal.

In this way, according to the decoding apparatus (spectrum decoding section 153) of this embodiment, it is possible to decode a signal coded in the coding apparatus of this embodiment.

Embodiment 2

In Embodiment 2 of the present invention, a second spectrum is estimated using a pitch filter having a first spectrum as an internal state, and the characteristics of this pitch filter are coded.

Figure 11:
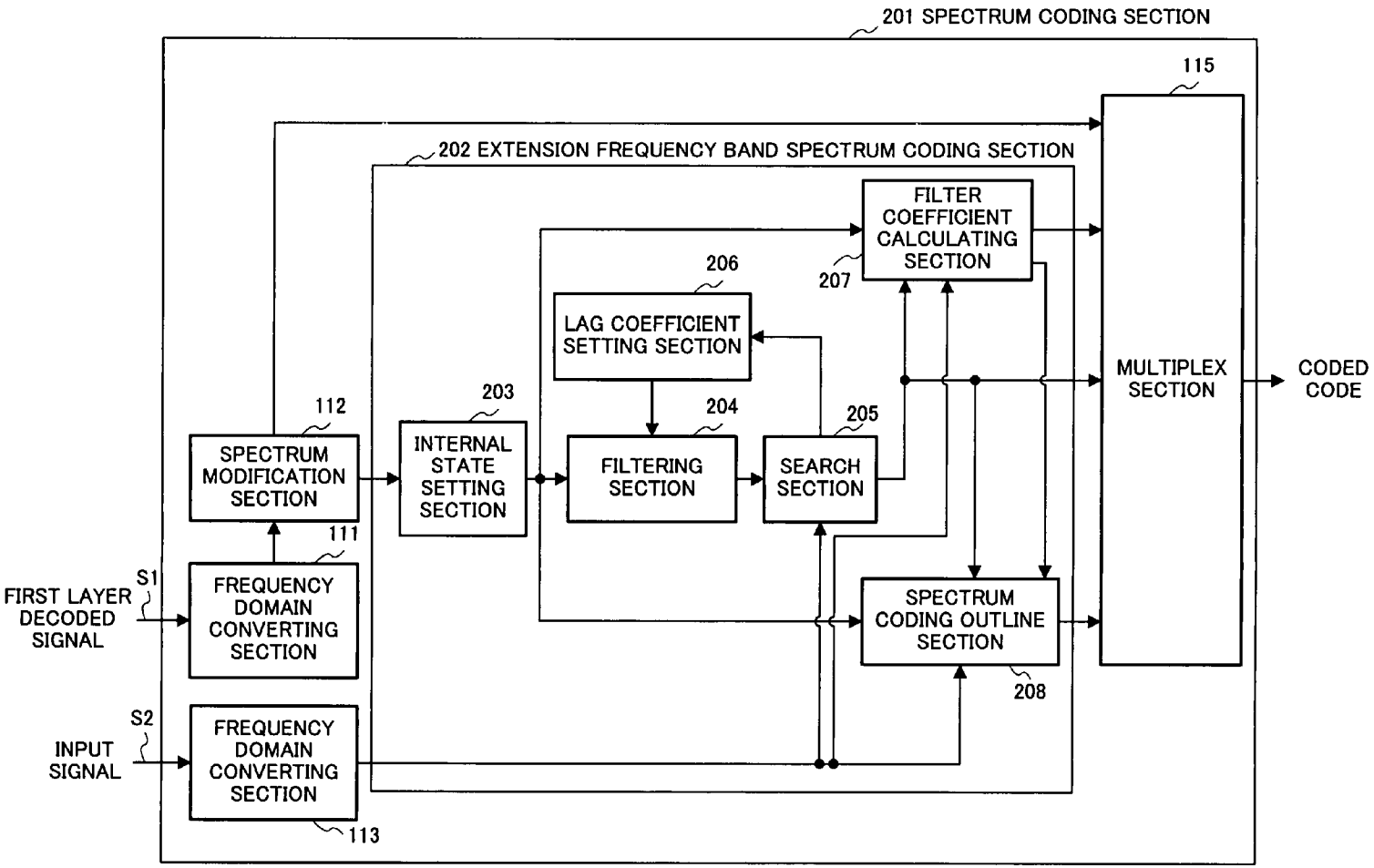
FIG. 11 is a block diagram illustrating a spectrum coding section according to Embodiment 2.

The configuration of the hierarchical coding apparatus according to this embodiment is the same as the hierarchical coding apparatus shown in Embodiment 1, and therefore spectrum coding section 201 which has a different configuration will be explained using the block diagram of FIG. 11. Components that are identical with spectrum coding section 106 (refer to FIG. 4) shown in Embodiment 1 will be assigned the same reference numerals without further explanations.

Internal state setting section 203 sets internal state S(k) of a filter used at filtering section 204 using modified first spectrum S1'(k) generated at spectrum modification section 112.

Filtering section 204 carries out filtering based on internal state S(k) of the filter set at internal state setting section 203 and lag coefficient T supplied from lag coefficient setting section 206, and calculates estimation value S2"(k) of the second spectrum. In this embodiment, a case of using a filter expressed by the following (Equation 13) will be described.

$$P(z) = \frac{1}{1 - \sum_{i=-M}^{M} \beta_i z^{-T+i}} \quad \text{(Equation 13)}$$

Here, T expresses a coefficient supplied from lag coefficient setting section 206, and it is assumed that M=1. As shown in the following (Equation 14), filtering processing at filtering section 204 calculates an estimation value by multiplying corresponding coefficient $\beta_i$ using the spectrums with frequency lower by frequency T as a center and performing addition in ascending order of the frequencies.

$$S(k) = \sum_{i=-1}^{1} \beta_i \cdot S(k - T - i) \quad \text{(Equation 14)}$$

Processing in accordance with this equation is carried out between FL≦k<FH. Here, S(k) indicates an internal state of the filter. S(k) calculated at this time (where FL≦k<FH) is used as estimation value S2"(k) of the second spectrum.

Search section 205 then calculates a degree of similarity of second spectrum S2($k$) supplied from frequency domain converting section 113 and estimation value S2"(k) of the second spectrum supplied from filtering section 204.

Various definitions exist for this degree of similarity, but in this embodiment, a degree of similarity calculated in accordance with the following (Equation 15) defined based on a minimum square error assuming filter coefficients $\beta_{-1}$ and $\beta_1$ to be 0 is used.

$$E = \sum_{k=FL}^{FH-1} S2(k)^2 - \frac{\left(\sum_{k=FL}^{FH-1} S2(k) \cdot S''2(k)\right)^2}{\sum_{k=FL}^{FH-1} S''2(k)^2} \quad \text{(Equation 15)}$$

In this method, filter coefficient $\beta_1$ is determined after optimum lag coefficient T is calculated. Here, E indicates the square error between S2($k$) and S2"(k). Further, the first term on the right side of (Equation 15) is a fixed value regardless of lag coefficient T. Therefore, lag coefficient T generating S2"(k) which makes the second term on the right side of (Equation 15) a maximum is searched. In this embodiment, the second term on the right side of (Equation 15) is referred to as the degree of similarity.

Lag coefficient setting section 206 then sequentially outputs lag coefficient T included in a predetermined search range of TMIN to TMAX to filtering section 204. Therefore, at filtering section 204, every time lag coefficient T is supplied from lag coefficient setting section 206, filtering is carried out after S(k) with a range of FL≦k<FH is cleared to zero, and search section 205 calculates the degree of similarity every time. Search section 205 then determines coefficient Tmax for the case where the calculated degree of similarity is a maximum, from between TMIN to TMAX, and supplies this coefficient Tmax to filter coefficient calculating section 207, spectrum outline coding section 208 and multiplex section 115.

Filter coefficient calculating section 207 obtains filter coefficient $\beta_i$ using coefficient Tmax supplied from search section 205. Here, filter coefficient $\beta_i$ is obtained so that square error E in accordance with the following (Equation 16) is a minimum.

$$E = \sum_{k=FL}^{FH-1}\left(S2(k) - \sum_{i=-1}^{1}\beta_i S(k - T_{max} - i)\right)^2 \quad \text{(Equation 16)}$$

Filter coefficient calculating section 207 has a combination of a plurality of $\beta_i$ as a table in advance, determines a combination of $\beta_i$ so that square error E of the above-described (Equation 16) is a minimum, outputs the code to multiplex section 115, and supplies filter coefficients $\beta_i$ to spectrum outline coding section 208.

Spectrum outline coding section 208 then carries out filtering using internal state S(k) supplied from internal state setting section 203, lag coefficient Tmax supplied from search section 205 and filter coefficients $\beta_i$ supplied from filter coefficient calculating section 207, and obtains estimation value S2"(k) of the second spectrum with band of FL≦k<FH. Spectrum outline coding section 208 then codes an adjustment coefficient of a spectrum outline using second spectrum estimation value S2"(k) and second spectrum S2(*k*).

In this embodiment, a case will be described where this spectrum outline information is expressed with spectral power for each subband. At this time, spectral power of the jth subband is expressed by the following (Equation 17).

$$B(j) = \sum_{k=BL(j)}^{BH(j)} S2(k)^2 \quad \text{(Equation 17)}$$

Here, BL(j) indicates the minimum frequency of the jth subband, and BH(j) indicates the maximum frequency of the jth subband. Spectral power of the subband of the second spectrum obtained in this way is then regarded as spectrum outline information of the second spectrum.

Similarly, spectrum outline coding section 208 calculates spectral power B"(j) of the subband of estimation value S2"(k) of the second spectrum in accordance with the following (Equation 18), and calculates the amount of fluctuation V(j) for each subband in accordance with the following (Equation 19).

$$B''(j) = \sum_{k=BL(j)}^{BH(j)} S''2(k)^2 \quad \text{(Equation 18)}$$

$$V(j) = \sqrt{\frac{B(j)}{B''(j)}} \quad \text{(Equation 19)}$$

Next, spectrum outline coding section 208 codes the amount of fluctuation V(j) and transmits this code to multiplex section 115.

Multiplex section 115 then multiplexes modification information obtained from spectrum modification section 112, information of optimum lag coefficient Tmax obtained from search section 205, information of the filter coefficient obtained from filter coefficient calculating section 207, and information of the spectrum outline adjustment coefficient obtained from spectrum outline coding section 208 and outputs the result.

According to this embodiment, the second spectrum is estimated using a pitch filter having the first spectrum as an internal state, and therefore it is only necessary to code only the characteristic of this pitch filter, so that a low bit rate can be realized.

In this embodiment, a case has been described where a frequency domain converting section is provided, but this is a component necessary when a time domain signal is used as input, and the frequency domain converting section is not necessary when the spectrum is directly inputted.

Further, in this embodiment, a case has been described as an example where M=1 in the above-described (Equation 13), but the value of M is not limited to 1, and it is possible to use integers of 0 or more.

Moreover, in this embodiment, a case has been described as an example where the pitch filter uses a filter function (transfer function) in the above-described (Equation 13), but the pitch filter may also be a first order pitch filter.

Figure 12:
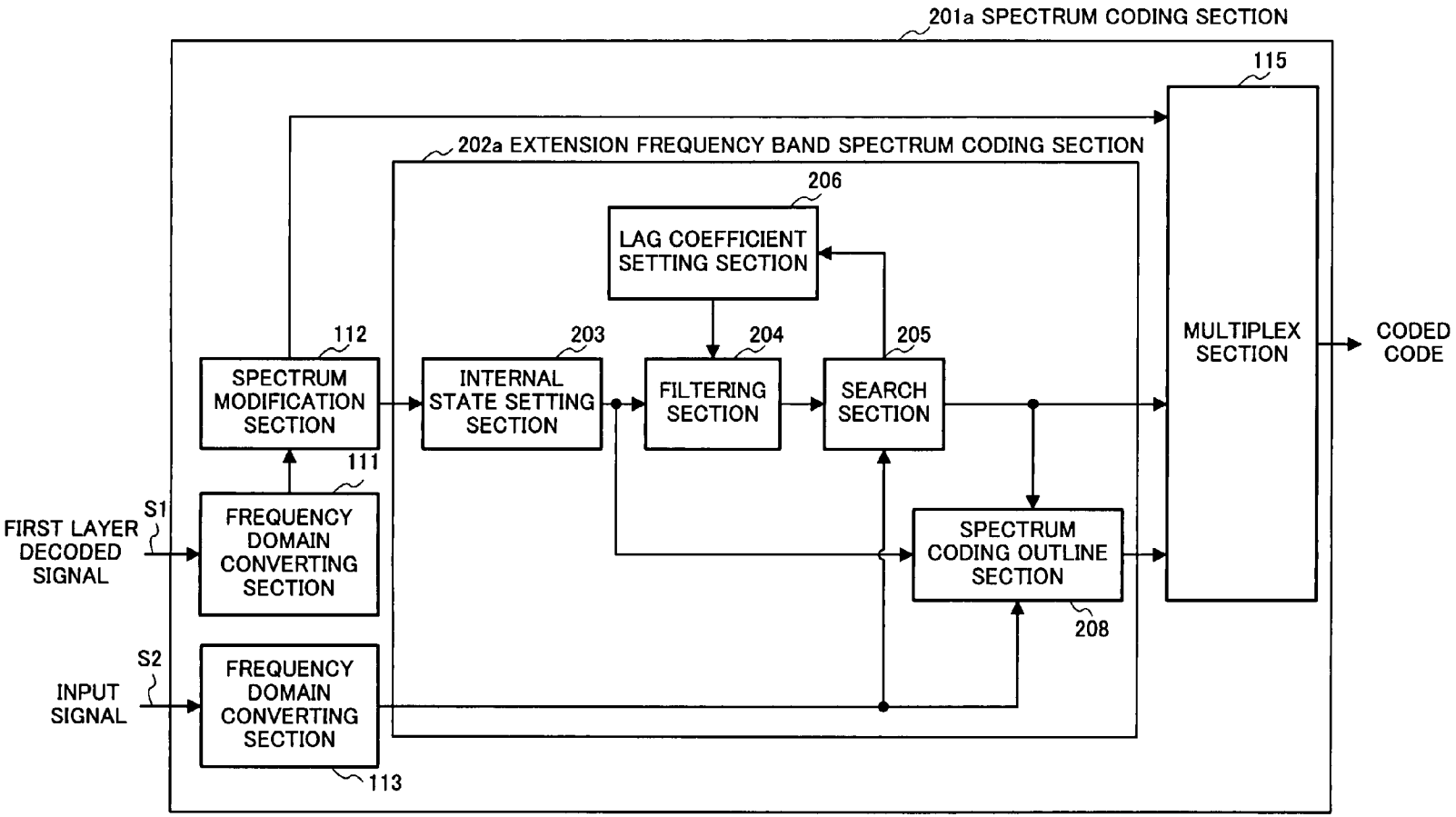
FIG. 12 is a block diagram showing a configuration of another variation of the spectrum coding section according to Embodiment 2.

FIG. 12 is a block diagram showing a configuration of another variation (spectrum coding section 201*a*) of spectrum coding section 201 according to this embodiment. Components that are identical with spectrum coding section 201 will be assigned the same reference numerals without further explanations.

The filter used at filtering section 204 may be simplified as shown in the following (Equation 20).

$$P(z) = \frac{1}{1 - z^{-T}} \quad \text{(Equation 20)}$$

This equation is a filter function for the case where M=0 and $\beta_0$=1 in the above-described (Equation 13). Estimation value S2"(k) of the second spectrum generated by this filter can be obtained by sequentially copying a low frequency band spectrum with internal state S(k) separated by just T using the following (Equation 21).

$$S(k)=S(k-T) \quad \text{(Equation 21)}$$

Further search section 205 determines optimum coefficient Tmax by searching lag coefficient T that makes the above-described (Equation 15) a minimum. Coefficient Tmax obtained in this way is then supplied to multiplex section 115.

By adopting the above-described configuration, the configuration of the filter used at filtering section 204 is simple, and filter coefficient calculating section 207 is unnecessary, so that it is possible to estimate the second spectrum with a small amount of calculation. According to this configuration, the configuration of the coding apparatus is simplified, and the amount of calculation in coding processing can be reduced.

Next, a configuration of spectrum decoding section 251 on the decoding side capable of decoding coded code generated at the above-described-spectrum coding section 201 (or spectrum coding section 201*a*) will be described in detail.

Figure 13:
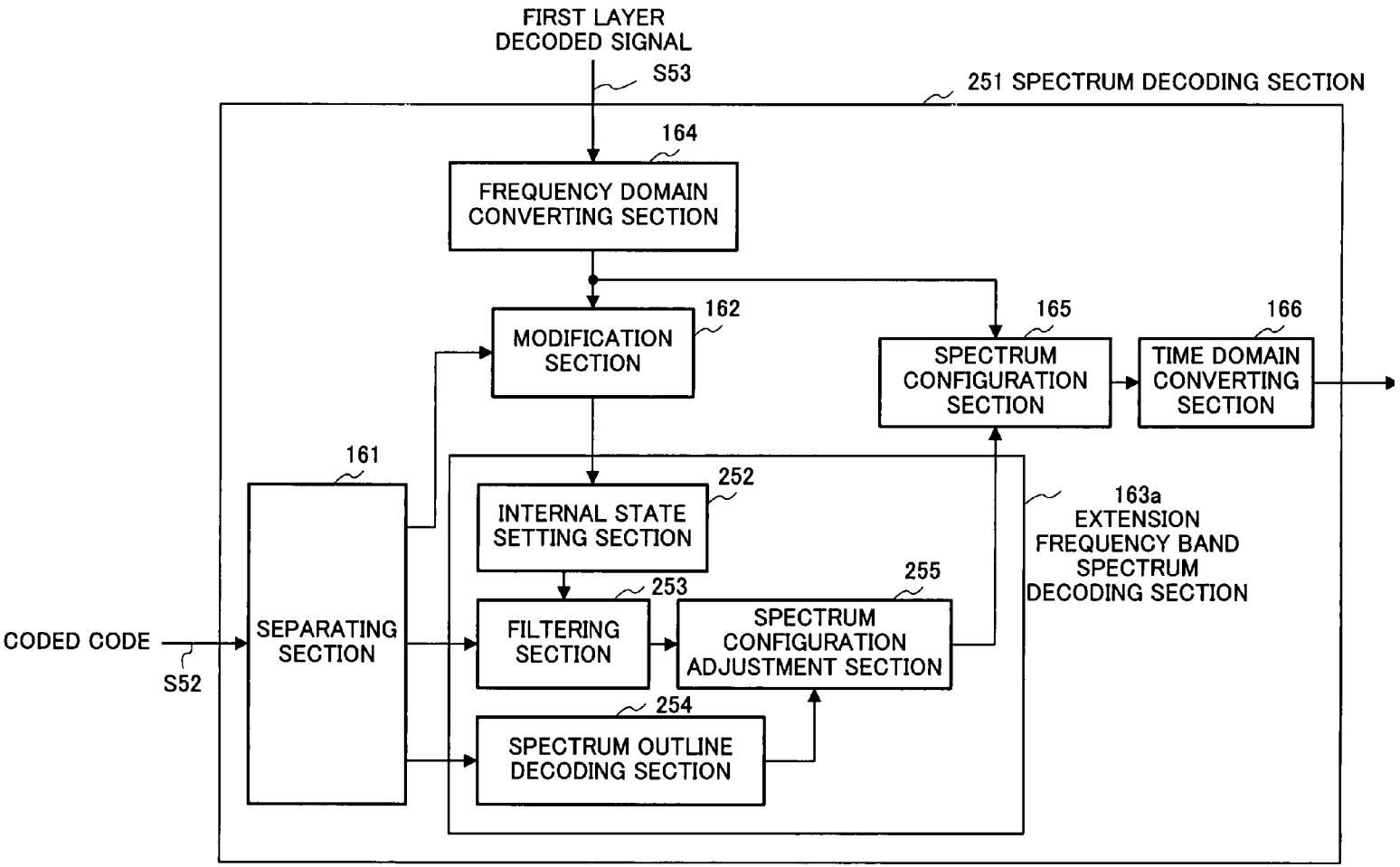
FIG. 13 is a block diagram showing the main configuration of a spectrum decoding section according to Embodiment 2.

FIG. 13 is a block diagram showing the main configuration of spectrum decoding section 251 according to this embodiment. This spectrum decoding section 251 has the same basic configuration as spectrum decoding section 153 (refer to FIG. 10) shown in Embodiment 1, and therefore components that are identical will be assigned the same reference numerals without further explanations. The difference is in the internal configuration of extension frequency band spectrum generating section 163*a*.

Internal state setting section 252 sets internal state S(k) of the filter used at filtering section 253 using modified first spectrum S1'(k) outputted from modification section 162.

Filtering section 253 obtains information relating to the filter via separating section 161 from the coded code generated at spectrum coding section 201 (201*a*) on the coding side. Specifically, in the case of spectrum coding section 201, lag coefficient Tmax and filter coefficient $\beta_i$ are obtained, and in the case of spectrum coding section 201*a*, only lag coefficient Tmax is obtained. Filtering section 253 then carries out filtering based on obtained filter information using modified first spectrum S1'(k) generated at modification section 162 as internal state S(k) of the filter, and calculates decoded spectrum S"(k). This filtering method depends on the filter function used in spectrum coding section 201(201*a*) on the coding side, and in the case of spectrum coding section 201, filtering is also carried out on the decoding side in accordance with the above-described (Equation 13), while in the case of spectrum coding section 201*a*, filtering is also carried out on the decoding side in accordance with the above-described (Equation 20).

Spectrum outline decoding section 254 decodes spectrum outline information based on the spectrum outline information supplied from separating section 161. In this embodiment, a case will be described as an example where quantizing value Vq(j) of the amount of fluctuation for each subband is used.

Spectrum adjusting section 255 adjusts the shape of the spectrum with frequency band of FL≦k<FH of spectrum S"(k) by multiplying spectrum S"(k) obtained from filtering section 253 by quantizing value Vq(j) of the amount of fluctuation for each subband obtained from spectrum outline decoding section 254 in accordance with the following (Equation 22), and generates estimation value S2"(k) of the second spectrum.

$$S''2(k)=S''(k)\cdot V_q(j)(BL(j)\leqq k\leqq BH(j),\ \text{for all}\ j) \qquad \text{(Equation 22)}$$

Here, BL(j) and BH(j) indicate the minimum frequency and maximum frequency of the jth subband respectively. Estimation value S2"(k) calculated in accordance with the above-described (Equation 22) is supplied to spectrum configuration section 165.

As described above in Embodiment 1, spectrum configuration section 165 integrates first spectrum S1(*k*) and estimation value S2"(k) of the second spectrum, generates decoded spectrum S3(*k*) and supplies this to time domain converting section 166.

In this way, according to the decoding apparatus (spectrum decoding section 251) according to this embodiment, it is possible to decode a signal coded in the coding apparatus according to this embodiment.

Embodiment 3

Figure 14:
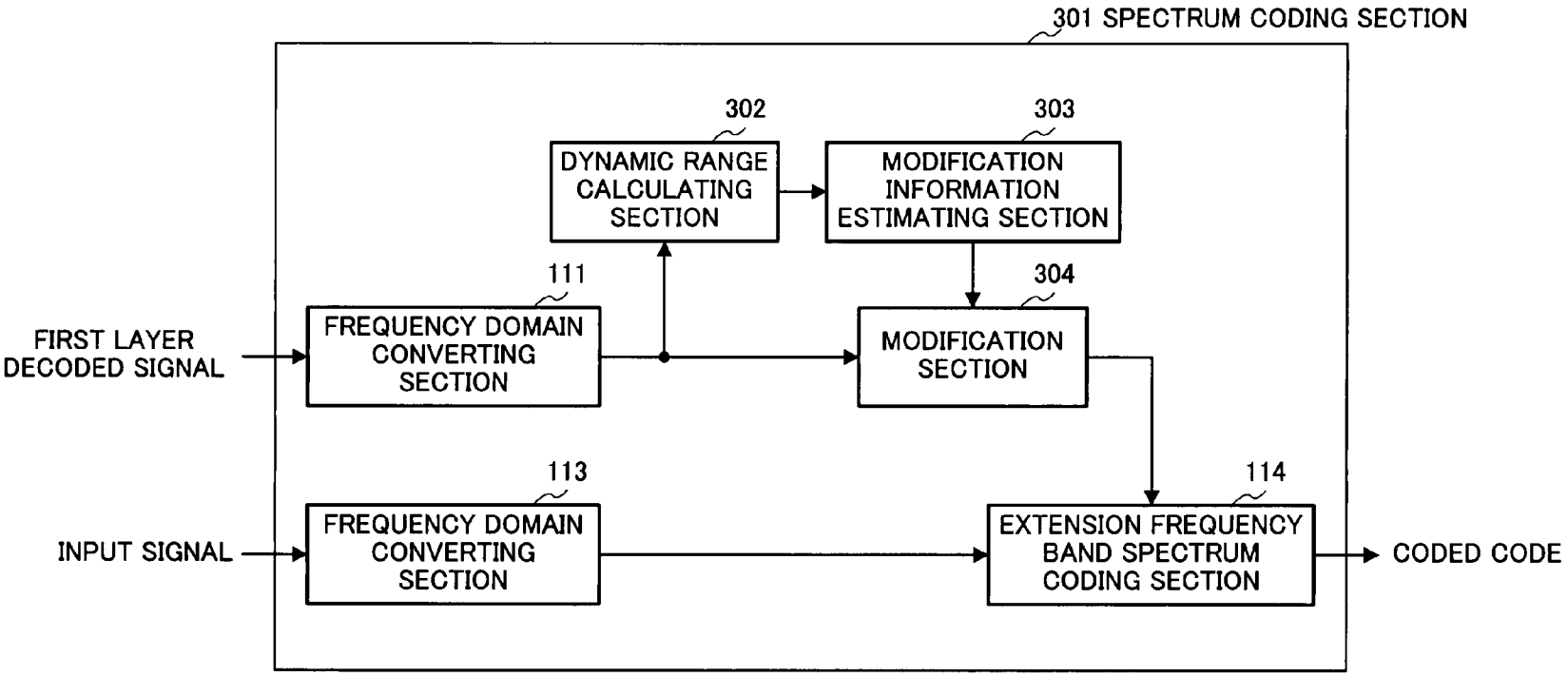
FIG. 14 is a block diagram showing the main configuration of a spectrum coding section according to Embodiment 3.

FIG. 14 is a block diagram showing the main configuration of a spectrum coding section according to Embodiment 3 of the present invention. In FIG. 14, blocks assigned with the same names and same reference numerals as in FIG. 4 have the same functions, and therefore explanations will be omitted. In Embodiment 3, the dynamic range of the spectrum is adjusted based on common information between the coding side and the decoding side. By this means, it is not necessary to output coded code indicating a dynamic range adjustment coefficient for adjusting the dynamic range of the spectrum. It is not necessary to output coded code indicating the dynamic range adjustment coefficient, so that a bit rate can be reduced.

Spectrum coding section 301 in FIG. 14 has dynamic range calculating section 302, modification information estimating section 303 and modification section 304 between frequency domain converting section 111 and extension frequency band spectrum coding section 114 instead of spectrum modification section 112 in FIG. 4. Spectrum modification section 112 in Embodiment 1 investigates a way of modifying (modification information) so as to obtain an appropriate dynamic range by changing the dynamic range of the first spectrum by variously modifying the first spectrum S1(*k*), and codes and outputs this modification information. On the other hand, in Embodiment 3, this modification information is estimated based on common information between the coding side and the decoding side, and modification of first spectrum S1(*k*) is carried out in accordance with estimated modification information.

Therefore, in the Embodiment 3, instead of spectrum modification section 112, dynamic range calculating section 302, modification information estimating section 303, and modification section 304 that modifies the first spectrum based on this estimated modification information are provided. In addition, since modification information can be obtained by estimation inside the spectrum coding section and spectrum decoding section described later, it is not necessary to output modification information as coded code from spectrum coding section 301, and therefore multiplex section 115 provided at spectrum coding section 106 in FIG. 4 is no longer necessary.

First spectrum S1(*k*) is then outputted from frequency domain converting section 111 and is supplied to dynamic range calculating section 302 and modification section 304. Dynamic range calculating section 302 quantizes the dynamic range of first spectrum S1(*k*) and outputs the result as dynamic range information. As with Embodiment 1, the method for quantizing the dynamic range is to divide the frequency band of the first spectrum into a plurality of subbands, obtain energy for a predetermined range of subbands (subband energy), calculate an appropriate subband energy variance value, and output the variance value as dynamic information.

Figure 15:
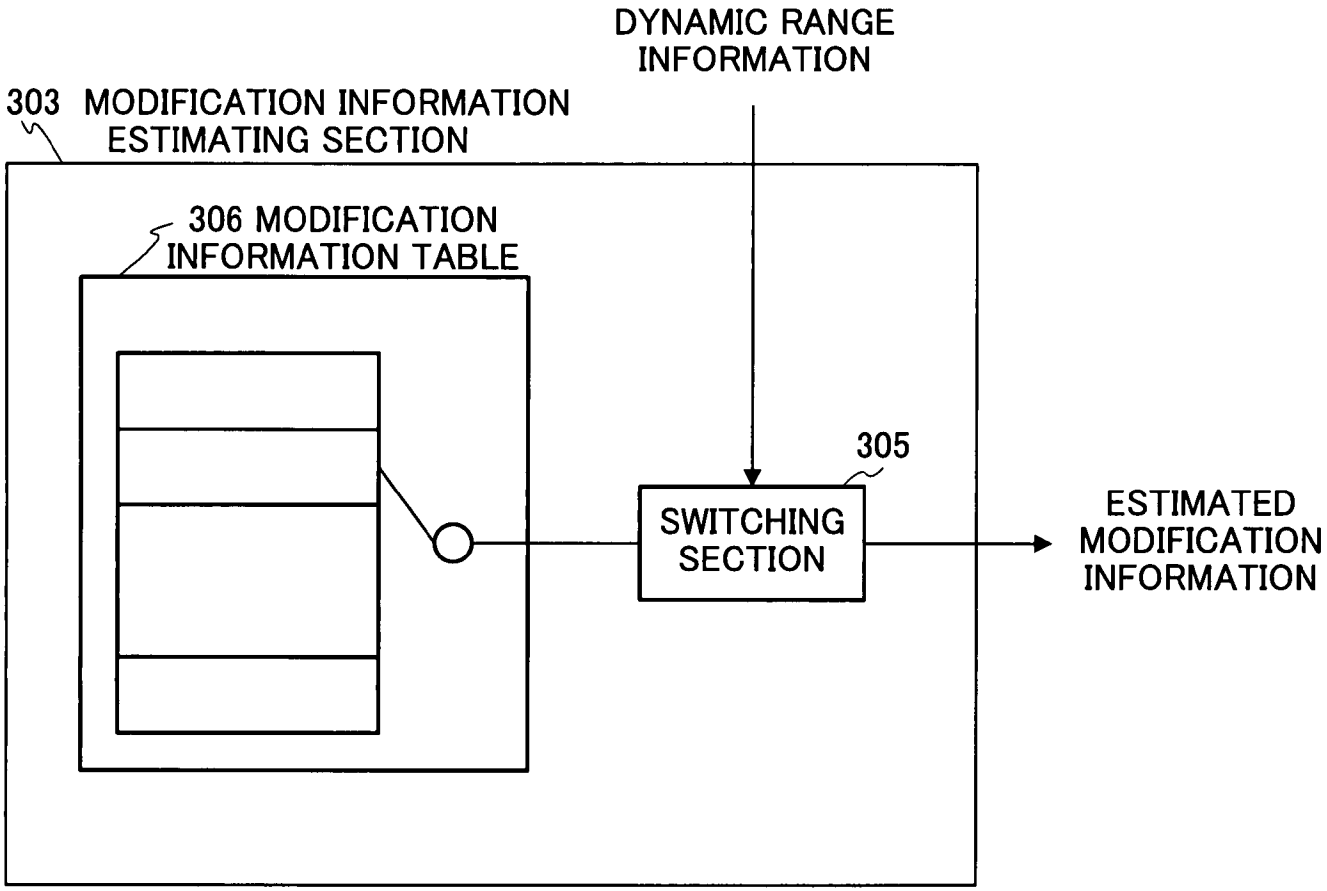
FIG. 15 illustrates a modification information estimating section according to Embodiment 3.

Next, modification information estimating section 303 will be described using FIG. 15. At modification information estimating section 303, dynamic range information is inputted from dynamic range calculating section 302 and supplied to switching section 305. Switching section 305 then selects and outputs one estimated modification information from candidates for estimated modification information recorded in modification information table 306 based on the dynamic range information. A plurality of candidates for estimated modification information taking values between 0 and 1 are recorded in modification information table 306, and these candidates are determined in advance through study so as to correspond to the dynamic range information.

Figure 16:
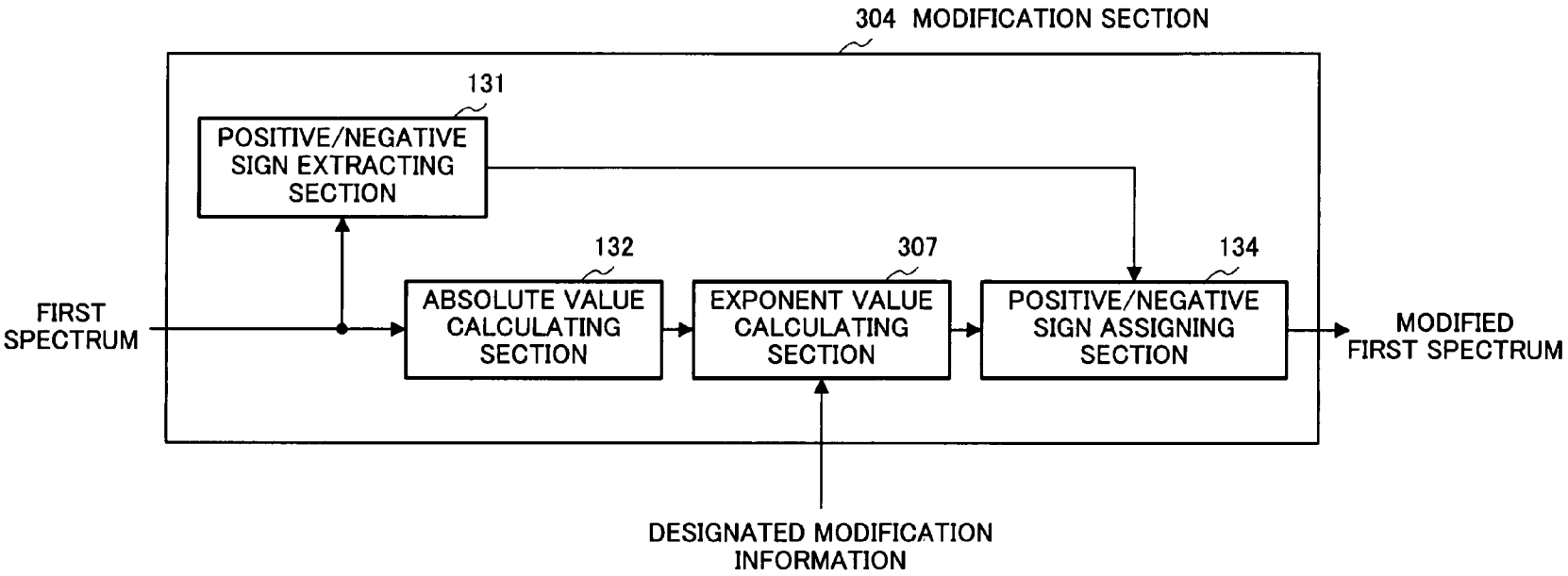
FIG. 16 is a block diagram showing the main configuration of the modification section according to Embodiment 3.

FIG. 16 is a block diagram showing the main configuration of modification section 304. Blocks assigned with the same names and same reference numerals as in FIG. 6 have the same functions, and therefore explanations will be omitted. Exponent value calculating section 307 of modification section 304 in FIG. 16 outputs an exponent value of absolute amplitude of a spectrum outputted from absolute value calculating section 132—a value that is raised to the power of estimated modification information—to positive/negative sign assigning section 134 in accordance with estimated modification information (taking values between 0 and 1) supplied from modification information estimating section 303. Positive/negative sign assigning section 134 assigns coded information obtained in advance at positive/negative sign extracting section 131 to the exponent value outputted from exponent value calculating section 307 and outputs the result as modified first spectrum.

As described above, according to the coding apparatus (spectrum coding section 301) of this embodiment, by estimating the high frequency band (FL≦k<FH) of the second spectrum (0≦k<FH) obtained from second signal using the first spectrum (0≦k<FL) obtained from the first signal, and performing the above-described estimation after applying modification to the first spectrum without using the first spectrum as is in the case where estimation information is coded, it is possible to appropriately adjust the dynamic range of the estimated spectrum and improve the subjective quality of the decoded signal. At this time, information indicating how the modification has been performed (modification information) is defined based on common information between the coding side and the decoding side (the first spectrum in Embodiment 3), so that it is not necessary to transmit coded code relating to modification information to the decoding section, and the bit rate can be reduced.

At modification information estimating section 303, it is also possible to use a mapping function taking dynamic range information of a first spectrum as an input value and estimated modification information as an output value, instead of making dynamic range information of the first spectrum correspond to the estimated modification information using modification information table 306. In this case, estimated modification information that is an output value of a function is limited so as to take values between 0 and 1.

Figure 17:
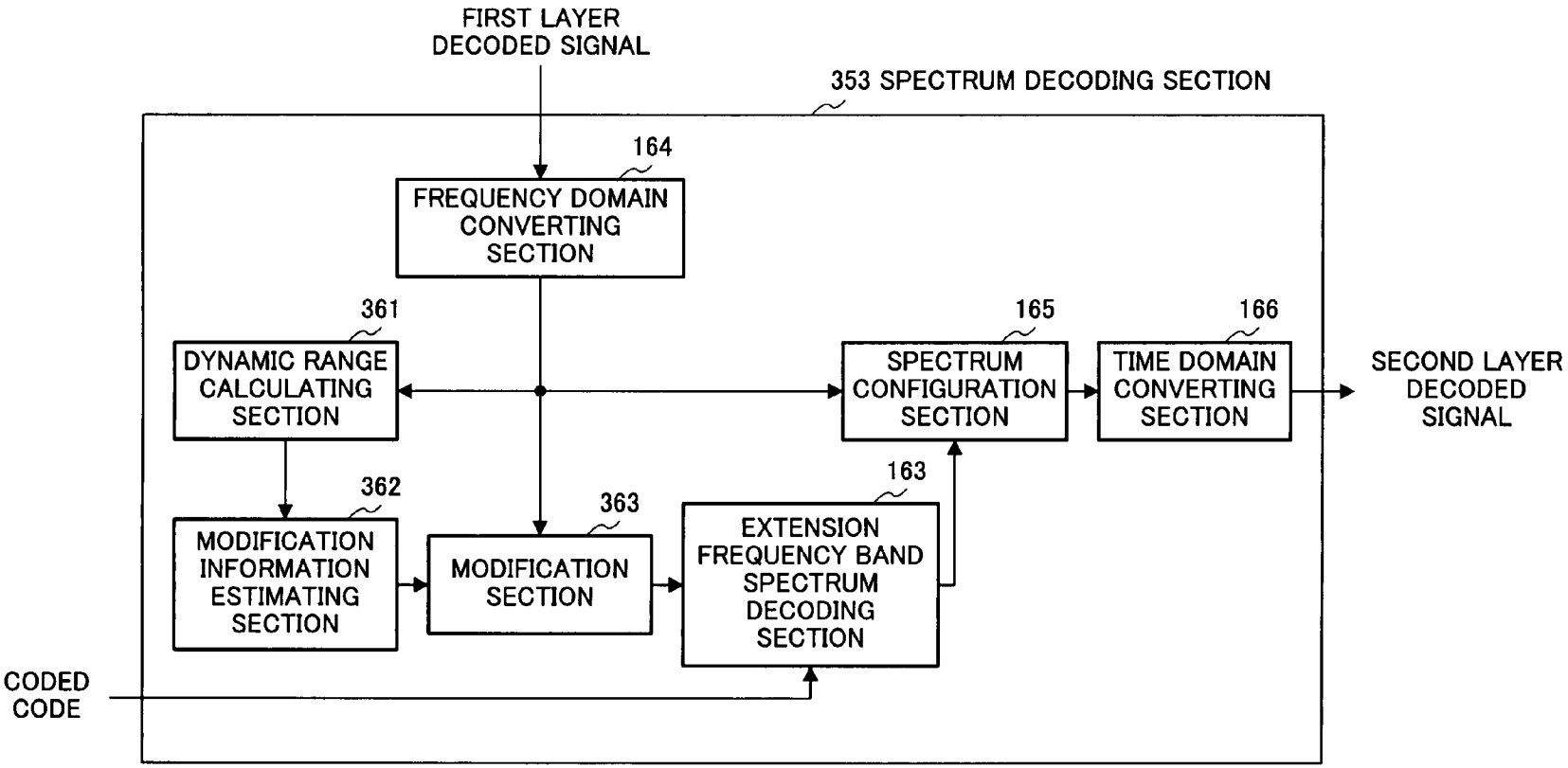
FIG. 17 is a block diagram showing the main configuration of a spectrum decoding section according to Embodiment 3.

FIG. 17 is a block diagram showing the main configuration of spectrum decoding section 353 according to Embodiment 3. In this configuration, blocks assigned with the same names and same reference numerals as in FIG. 10 have the same functions, and therefore explanations will be omitted. Dynamic range calculating section 361, modification information estimating section 362 and modification section 363 are provided between frequency domain converting section 164 and extension frequency band spectrum generating section 163. Modification section 162 in FIG. 10 receives modification information generated at spectrum modification section 112 on the coding side and performs modification on first spectrum S1(*k*) supplied from frequency domain converting section 164 based on this modification information. On the other hand, in Embodiment 3, as with the above-described spectrum coding section 301, modification information is estimated based on common information between the coding side and the decoding side, and modification of first spectrum S1(*k*) is carried out in accordance with the estimated modification information.

Therefore, in Embodiment 3, dynamic range calculating section 361, modification information estimating section 362 and modification section 363 are provided. As with spectrum coding section 301, since modification information can be obtained by estimation inside the spectrum decoding section, modification information is not included in the inputted coded code. Therefore, separating section 161 provided at spectrum decoding section 153 in FIG. 10 is no longer necessary.

First spectrum S1(*k*) is then outputted from frequency domain converting section 164 and supplied to dynamic range calculating section 361 and modification section 363. In the following, the operation of dynamic range calculating section 361, modification information estimating section 362 and modification section 363 is the same as dynamic range calculating section 302, modification information estimating section 303 and modification section 304 inside spectrum coding section 301 on the coding side described previously, and therefore explanations will be omitted. In modification information table inside modification information estimating section 362, the same candidates for estimated modification information as in modification information table 306 inside modification information estimating section 303 of spectrum coding section 301 are recorded.

Further, the operation of extension frequency band spectrum generating section 163, spectrum configuration section 165 and time domain converting section 166 is the same as described in FIG. 10 of Embodiment 1, and therefore explanations will be omitted.

According to the decoding apparatus (spectrum decoding section 353) of this embodiment, by decoding a signal coded at the coding apparatus according to this embodiment, it is possible to appropriately adjust the dynamic range of the estimated spectrum and improve subjective quality of the decoded signal.

In this embodiment, estimated modification information can be obtained at modification information estimating section 303, and this estimated modification information is applied to spectrum coding section 106 shown in FIG. 4 of Embodiment 1 to supply the estimated modification information to spectrum modification section 112. At spectrum modification section 112, the adjacent modification information is selected from exponent variable table 135 using the estimated modification information supplied from modification information estimating section 303 as a reference, and the optimum modification information is determined from the limited modification information at search section 125. In this configuration, coded code of the finally selected modification information is indicated as a relative value from estimated modification information used as the reference. In this way, accurate modification information is coded and transmitted to the decoding section, so that it is possible to obtain the advantage of reducing the number of bits indicating the modification information while maintaining subjective quality of the decoded signal.

Embodiment 4

In Embodiment 4 of the present invention, estimated modification information outputted to the modification section inside the spectrum coding section is determined based on pitch gain supplied from the first layer coding section.

Figure 18:
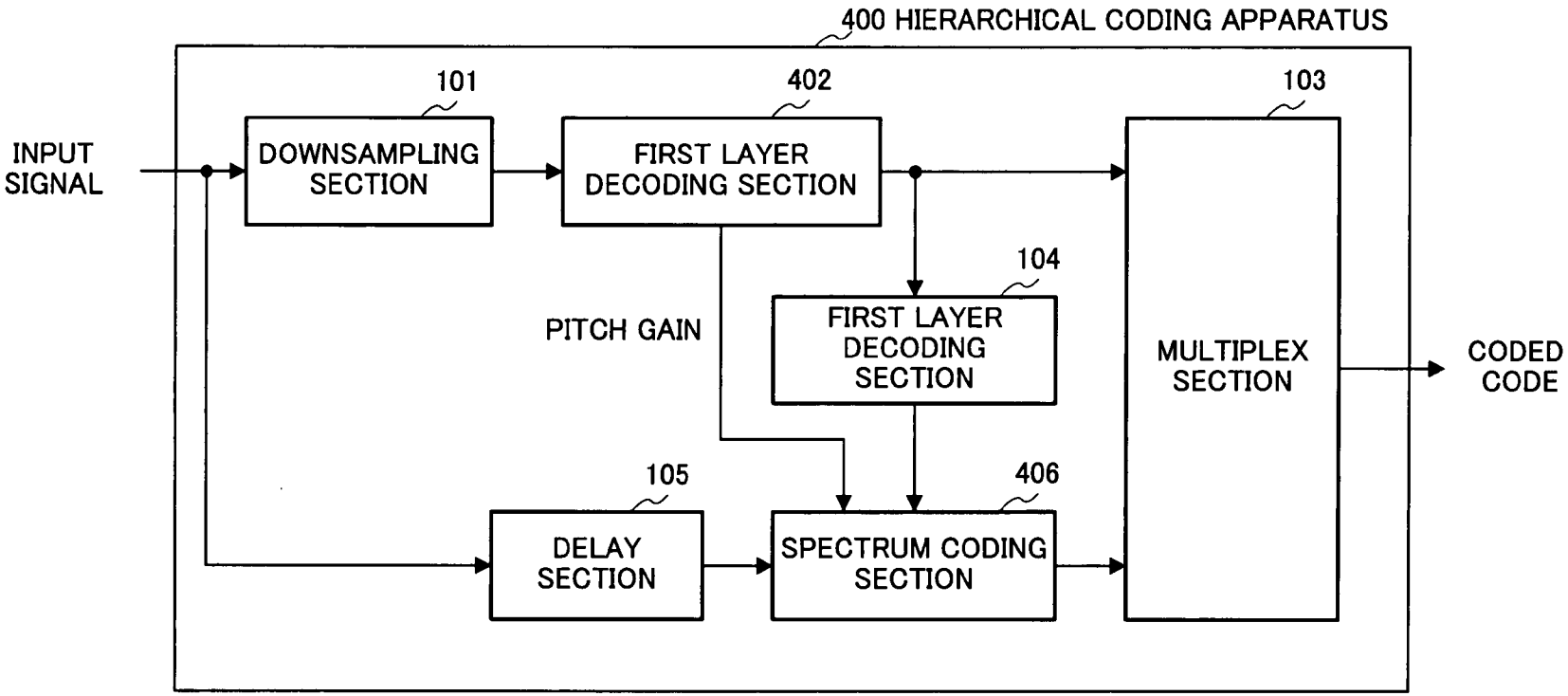
FIG. 18 is a block diagram showing the main configuration of a hierarchical coding apparatus according to Embodiment 4.

FIG. 18 is a block diagram showing the main configuration of hierarchical coding apparatus 400 according to this embodiment. In FIG. 18, blocks assigned with the same names and same reference numerals as in FIG. 3 have the same functions, and therefore explanations will be omitted.

At hierarchical coding apparatus 400 of Embodiment 4, pitch gain obtained at first layer coding section 402 is supplied to spectrum coding section 406. Specifically, at first layer coding section 402, adaptive code vector gain multiplied with adaptive code vectors outputted from an adaptive codebook (not shown) within first layer coding section 402 is outputted as pitch gain and inputted to spectrum coding section 406. This adaptive code vector gain has a feature of taking a large value when periodicity of the input signal is strong, and a small value when periodicity of the input signal is weak.

Figure 19:
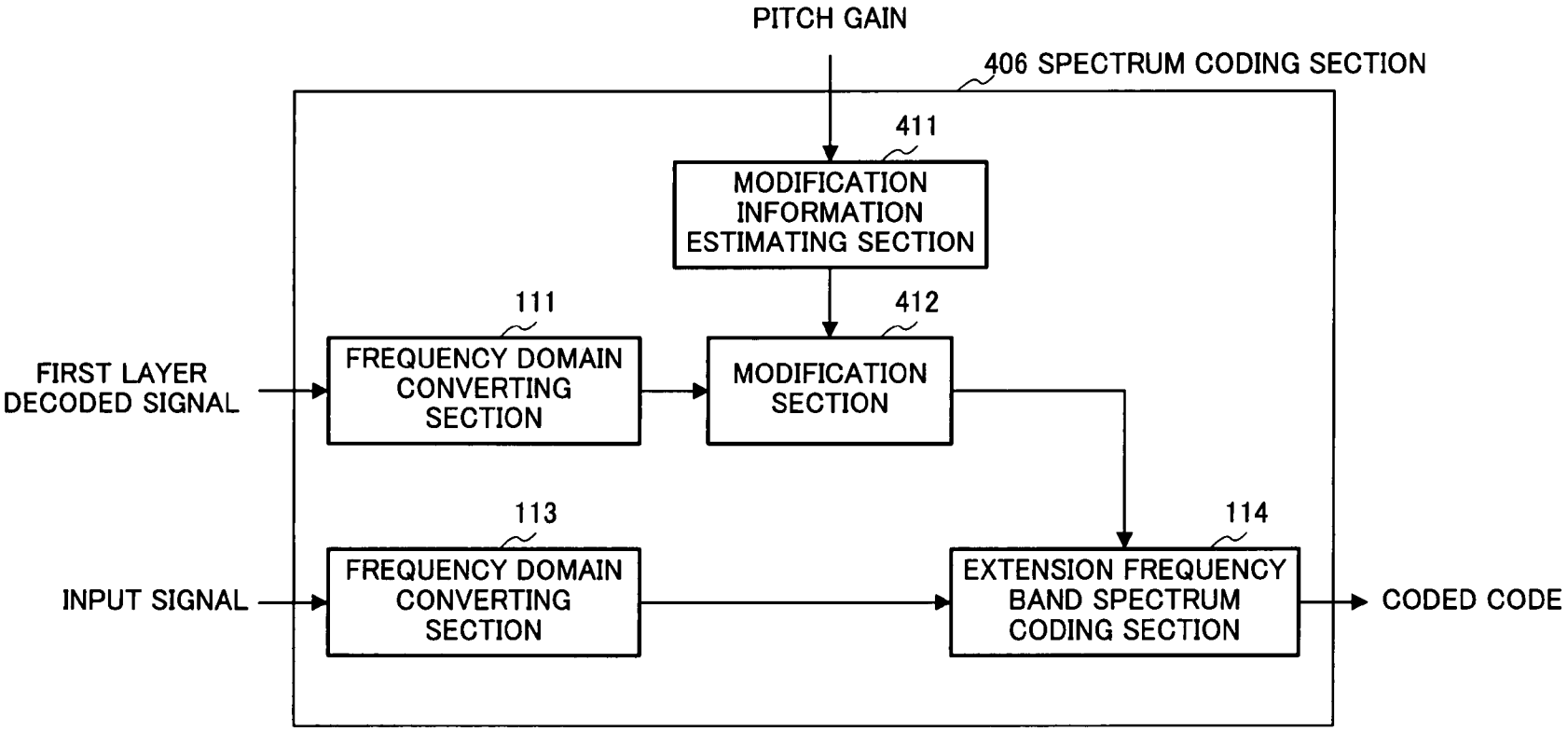
FIG. 19 is a block diagram showing the main configuration of a spectrum coding section according to Embodiment 4.

FIG. 19 is a block diagram showing the main configuration of spectrum coding section 406 according to Embodiment 4. In FIG. 19, blocks assigned with the same names and same reference numerals as in FIG. 14 have the same functions, and therefore explanations will be omitted. Modification information estimating section 411 outputs estimated modification information using pitch gain supplied from first layer coding section 402. Modification information estimating section 411 adopts the same configuration as the above-described modification information estimating section 303 in FIG. 15. However, a modification information table designed for pitch gain is applied. In this embodiment also, it is possible to adopt a configuration using a mapping coefficient instead of the configuration using the modification information table.

According to the coding apparatus (spectrum coding section 406) of this embodiment, it is possible to appropriately adjust the dynamic range of the estimated spectrum with periodicity of an input signal taken into consideration, and improve subjective quality of the decoded signal.

Next, a configuration of hierarchical decoding apparatus 450 capable of decoding the coded code generated in the above-described hierarchical coding apparatus 400 will be described.

Figure 20:
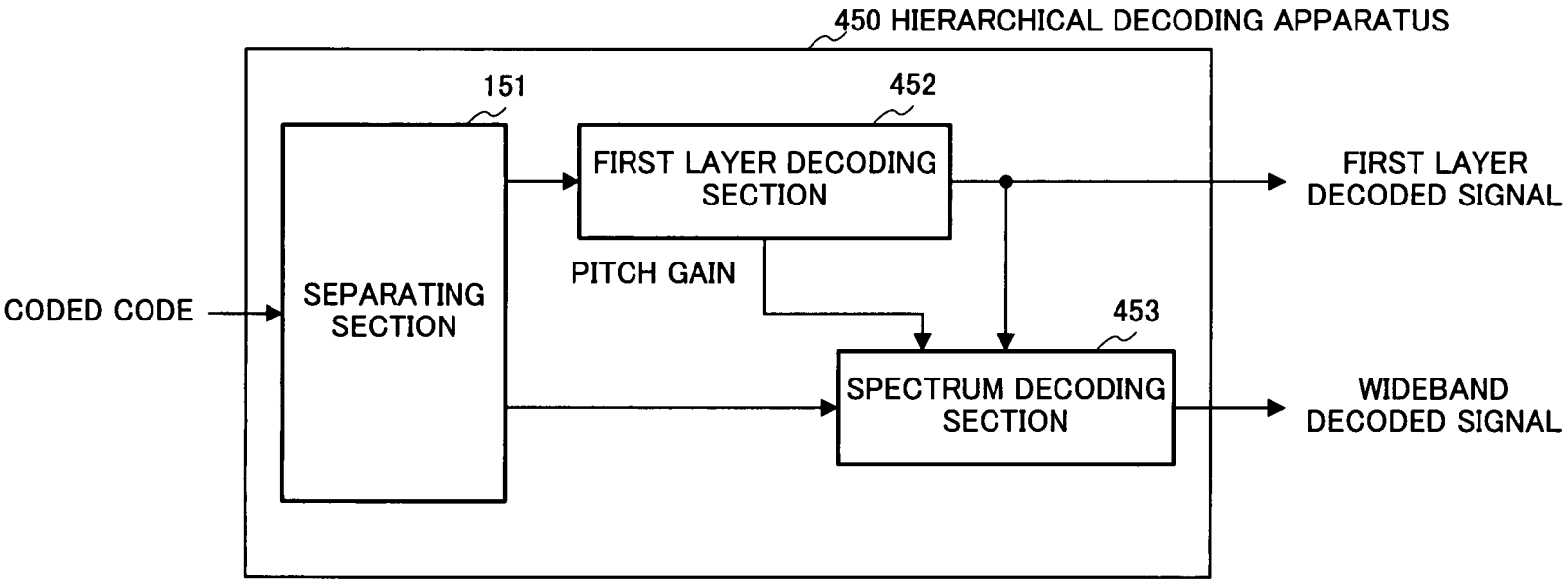
FIG. 20 is a block diagram showing the main configuration of a hierarchical decoding apparatus according to Embodiment 4.

FIG. 20 is a block diagram showing the main configuration of hierarchical decoding apparatus 450 according to this embodiment. In FIG. 20, pitch gain outputted from first layer decoding section 452 is supplied to spectrum decoding section 453. At first layer decoding section 452, adaptive code vector gain multiplied by the adaptive code vector outputted from the adaptive code book (not shown) within first layer decoding section 452 is outputted as pitch gain and inputted to spectrum decoding section 453.

Figure 21:
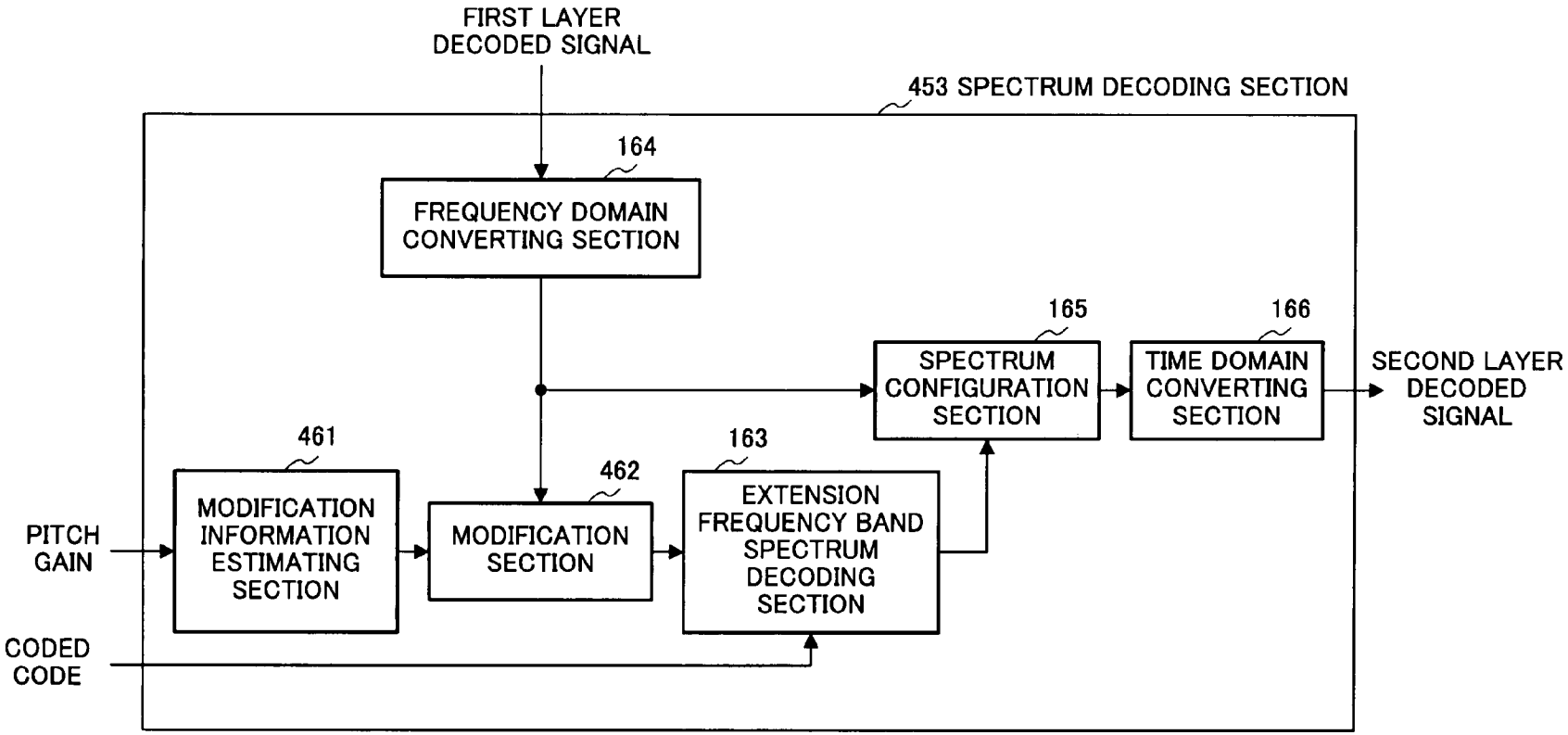
FIG. 21 is a block diagram showing the main configuration of a spectrum decoding section according to Embodiment 4.

FIG. 21 is a block diagram showing the main configuration of spectrum decoding section 453 according to Embodiment 4. Modification information estimating section 461 outputs estimated modification information using pitch gain supplied from first layer decoding section 452. Modification information estimating section 461 adopts the same configuration as the above-described modification information estimating section 303 in FIG. 15. However, a modification information table is applied that is the same as that within modification information estimating section 411 and is designed for pitch gain. In this embodiment also, it is possible to adopt a configuration using the mapping coefficient instead of the configuration using the modification information table.

According to the decoding apparatus (spectrum decoding section 453) of this embodiment, by decoding a signal coded at the coding apparatus of this embodiment, it is possible to appropriately adjust the dynamic range of the estimated spectrum with periodicity of an input signal taken into consideration, and improve subjective quality of the decoded signal.

It is also possible to adopt a configuration of estimating modification information using pitch gain and pitch period (lag obtained as a result of searching the adaptive code book within first layer coding section 402). In this case, by using pitch period, it is possible to perform estimation of modification information suitable for each of speech with a short pitch period (for example, a female voice) and speech with a long pitch period (for example, a male voice) and thereby improve estimation accuracy.

Further, in this embodiment, estimated modification information can be obtained at modification information estimating section 411, and, as with in Embodiment 3, this estimated modification information is applied to spectrum coding section 106 shown in FIG. 4 of Embodiment 1, and the estimated modification information is supplied to spectrum modification section 112. At spectrum modification section 112, the adjacent modification information is selected from exponent variable table 135 using the estimated modification information supplied from modification information estimating section 411 as a reference, and the optimum modification information is determined from the limited modification information at search section 125. In this configuration, coded code of the finally selected modification information is indicated as a relative value from estimated modification information used as the reference. In this way, accurate modification information is coded and transmitted to the decoding section, so that it is possible to obtain an advantage of reducing the number of bits indicating the modification information while maintaining subjective quality of the decoded signal.

Embodiment 5

In Embodiment 5 of the present invention, estimated modification information outputted to the modification section within the spectrum coding section is determined based on LPC coefficients supplied from the first layer coding section.

The configuration of the hierarchical coding apparatus according to Embodiment 5 is the same as the above-described FIG. 18. However, a parameter outputted from first layer coding section 402 to spectrum coding section 406 is not pitch gain but LPC coefficients.

Figure 22:
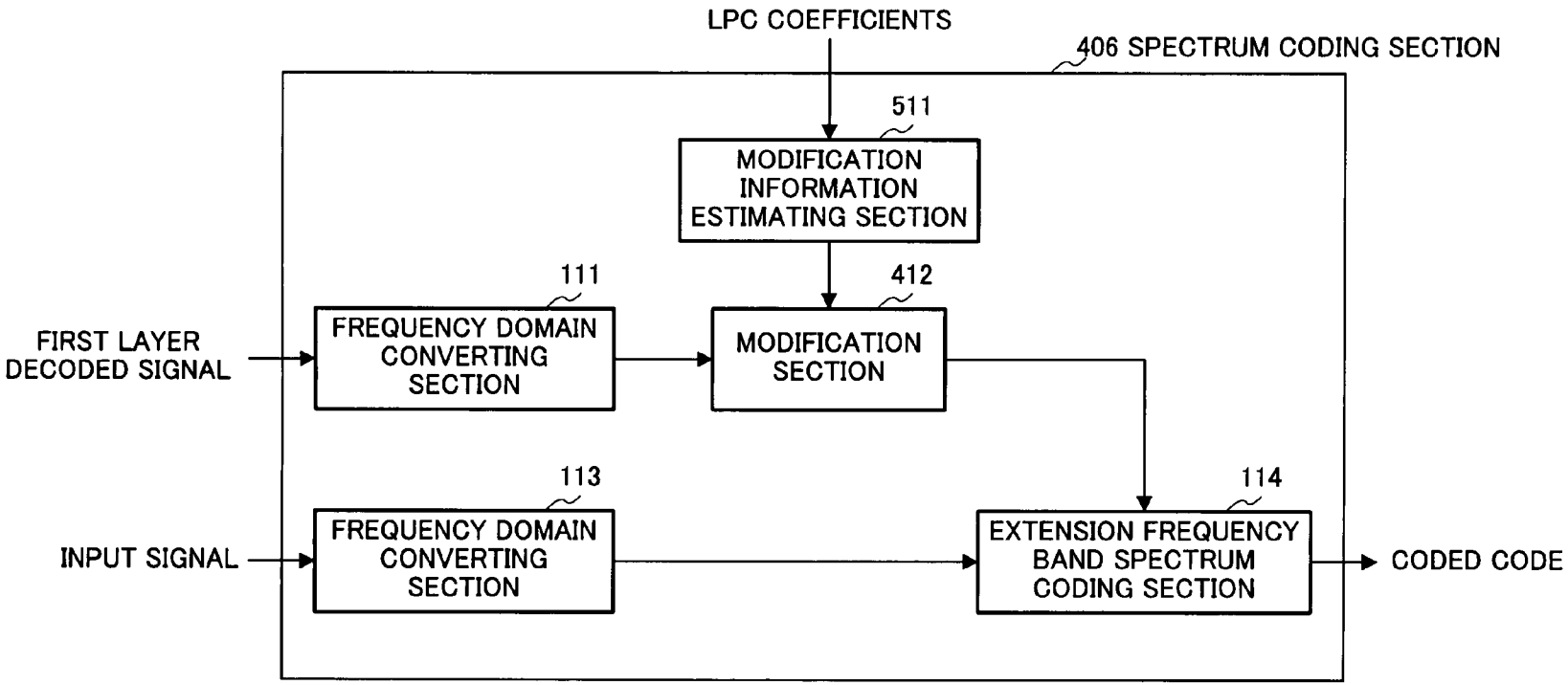
FIG. 22 is a block diagram showing the main configuration of a spectrum coding section according to Embodiment 5.

The main configuration of spectrum coding section 406 according to this embodiment is as shown in FIG. 22. The difference from the above-described FIG. 19 is that the parameter supplied to modification information estimating section 511 is not pitch gain but LPC coefficients, and it is the internal configuration of modification information estimating section 511.

Figure 23:
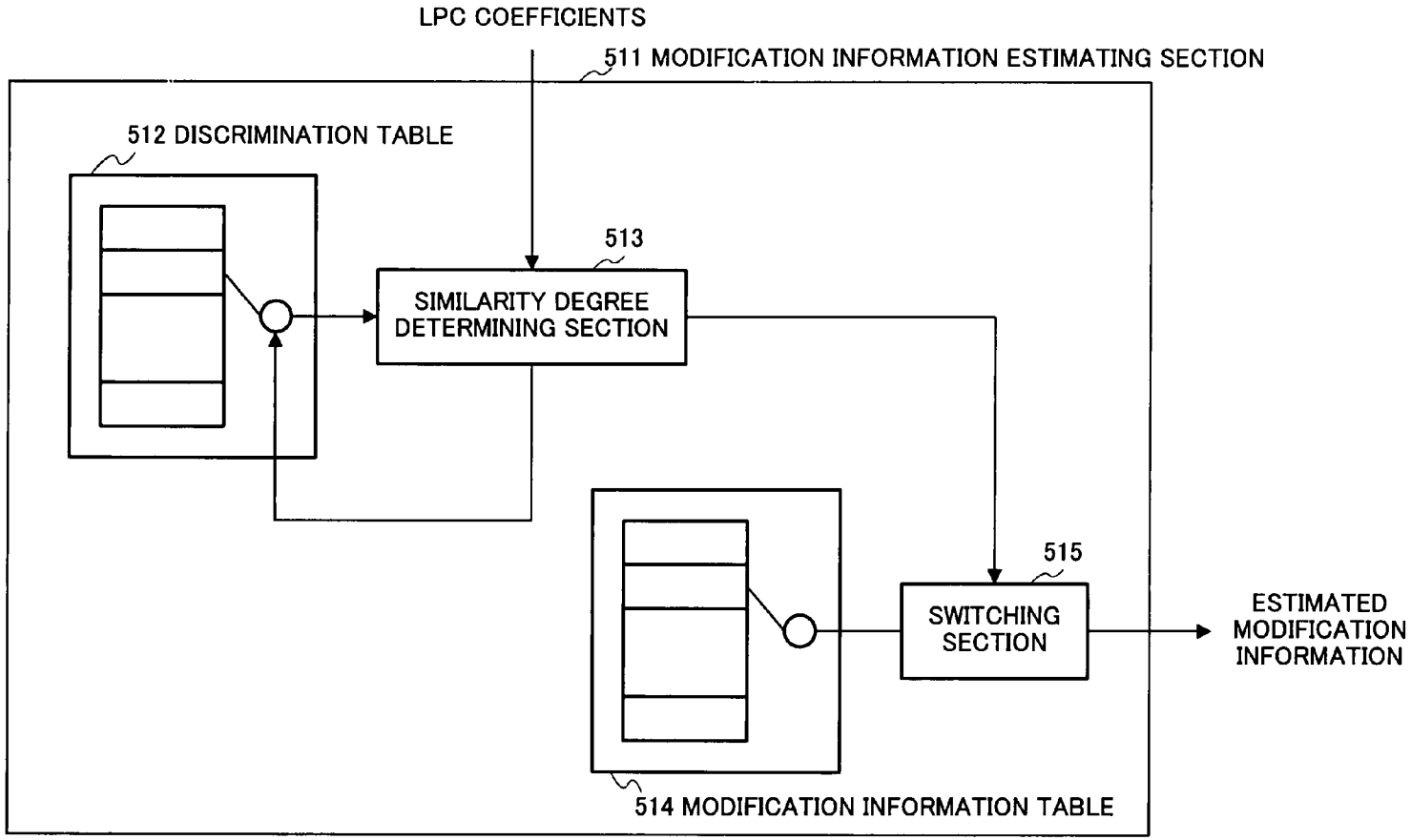
FIG. 23 is a block diagram showing the main configuration of a modification information estimating section according to Embodiment 5.

FIG. 23 is a block diagram showing the main configuration of modification information estimating section 511 according to this embodiment. Modification information estimating section 511 is configured with determination table 512, similarity degree determining section 513, modification information table 514 and switching section 515. As with modification information table 306 in FIG. 15, candidates for estimated modification information are recorded in modification information table 514. However, candidates for estimated modification information designed for LPC coefficients are applied. Candidates for the LPC coefficients are stored in determination table 512, and determination table 512 corresponds to modification information table 514. Namely, when a jth candidate for the LPC coefficients is selected from determination table 512, estimated modification information suitable for this candidate for LPC coefficients is stored in jth of modification information table 514. The LPC coefficients have a feature of capable of accurately expressing the spectrum outline (spectrum envelope) with few parameters, and it is possible to make this spectrum outline correspond to estimated modification information controlling the dynamic range. This embodiment is configured using this feature.

Similarity degree determining section 513 obtains LPC coefficients which are the most similar to the LPC coefficients supplied from first layer coding section 402 from determination table 512. In this determination of the degree of similarity, the distance (distortion) between LPC coefficients or distortion between the LPC coefficients and LPC coefficients converted to other parameters such as LSP (Line Spectrum Pairs) coefficients, are obtained, and the LPC coefficients for the case where the distortion is a minimum are then obtained from determination table 512.

An index indicating a candidate for the LPC coefficients within determination table 512 for the case where distortion is a minimum (that is, the degree of similarity is highest) are outputted from similarity degree determining section 513 and supplied to switching section 515. Switching section 515 then selects a candidate for estimated modification information indicated by this index, and this is outputted from modification information estimating section 511.

According to the coding apparatus (spectrum coding section 406) of this embodiment, it is possible to appropriately adjust the dynamic range of the estimated spectrum with spectral outline of an input signal also taken into consideration, and improve subjective quality of the decoded signal.

Next, the configuration of the hierarchical decoding apparatus capable of decoding the coded code generated in the coding apparatus according to Embodiment 5 will be described.

The configuration of the hierarchical decoding apparatus according to Embodiment 5 is the same as the above-described FIG. 20. However, a parameter outputted from first layer decoding section 452 to spectrum decoding section 453 is not pitch gain but LPC coefficients.

Figure 24:
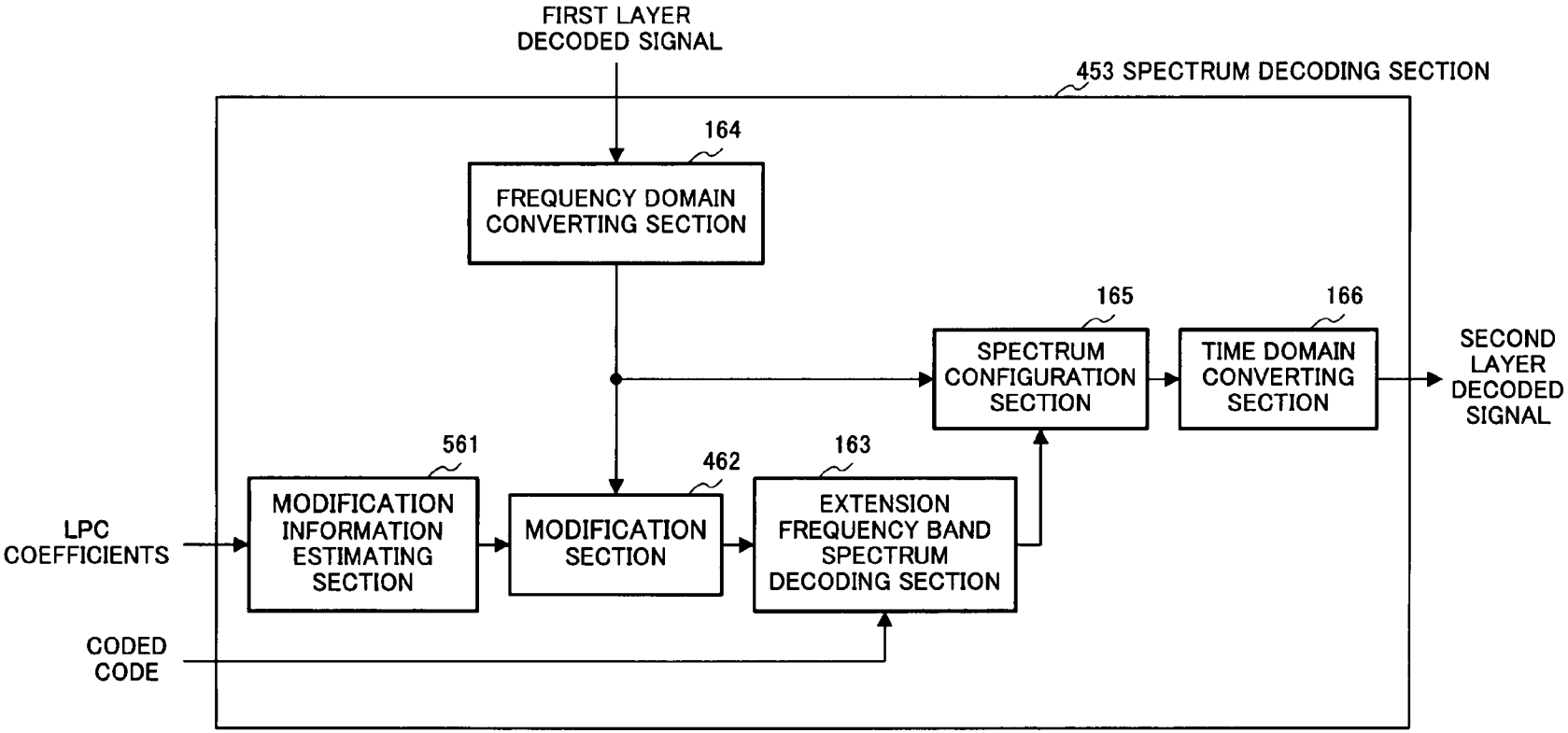
FIG. 24 is a block diagram showing the main configuration of a spectrum decoding section according to Embodiment 5.

The main configuration of spectrum decoding section 453 according to this embodiment is as shown in FIG. 24. The difference from the above-described FIG. 21 is that the parameter supplied to modification information estimating section 561 is not pitch gain but LPC coefficients, and it is the internal configuration of modification information estimating section 561.

The internal configuration of modification information estimating section 561 is the same as modification information estimating section 511 within spectrum coding section 406 in FIG. 22, that is, the same as shown in FIG. 23, and information recorded in determination table 512 and modification information table 514 is common between the coding side and decoding side.

According to the decoding apparatus (spectrum decoding section 453) of this embodiment, by decoding a signal coded at the coding apparatus of this embodiment, it is possible to appropriately adjust the dynamic range of the estimated spectrum with the spectrum outline of the input signal also taken into consideration, and improve subjective quality of the decoded signal.

Further, in this embodiment, estimated modification information is obtained at modification information estimating section 511, and, as with in Embodiment 4, this estimated modification information is applied to spectrum coding section 106 shown in FIG. 4 of Embodiment 1, and the estimated modification information is supplied to spectrum modification section 112. At spectrum modification section 112, the adjacent modification information is selected from exponent variable table 135 using the estimated modification information supplied from modification information estimating section 511 as a reference, and the optimum modification information is determined from the limited modification information at search section 125. In this configuration, coded code of the finally selected modification information is indicated as a relative value from the estimated modification information used as the reference. In this way, accurate modification information can be coded and transmitted to the decoding section, so that it is possible to obtain an advantage of reducing the number of bits indicating the modification information while maintaining subjective quality of the decoded signal.

Embodiment 6

The basic configuration of the hierarchical coding apparatus according to Embodiment 6 of the present invention is the same as the hierarchical coding apparatus shown in Embodiment 1, and therefore explanations will be omitted, and just spectrum modification section 612 with a different configuration from spectrum modification section 112 will be described below.

Spectrum modification section 612 applies the following modification to first spectrum S1($k$) so that the dynamic range of first spectrum S1($k$) [$0 \leqq k < FL$] becomes close to the dynamic range of a high frequency band of second spectrum S2($k$) [$FL \leqq k < FH$]. Spectrum modification section 612 then codes and outputs the modification information about this modification.

Figure 25:
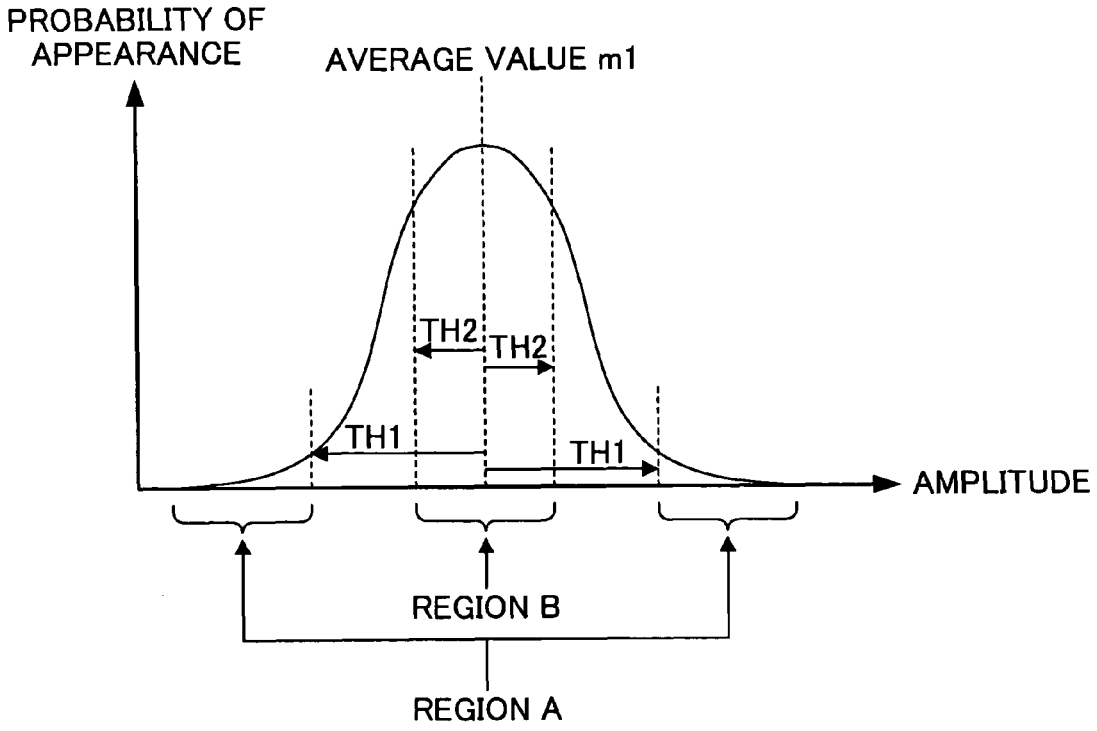
FIG. 25 illustrates a spectrum modification method according to Embodiment 6.

FIG. 25 illustrates a spectrum modification method according to this embodiment.

This drawing shows amplitude distribution of first spectrum S1($k$). First spectrum S1($k$) indicates amplitude differing according to values of frequency k [$0 \leqq k < FL$]. Here, when the horizontal axis is taken as amplitude and the vertical axis is taken as appearing probability at this amplitude, a distribution similar to normal distribution shown in the drawing appears centered on average value m1 of the amplitude.

In this embodiment, first, this distribution can be roughly divided into a group (region B in the drawing) close to average value m1 and a group (region A in the drawing) far from average value m1. Next, typical values of amplitude of these two groups, specifically, an average value of spectral amplitude included in region A and an average value of spectral amplitude included in region B, are obtained. Here, the absolute value of amplitude for the case where average value m1 is re-converted to zero (average value m1 is subtracted from each value) is used. For example, region A is made up of two regions of a region where amplitude is greater than average value m1 and a region where amplitude is smaller than average value m1, but by re-converting average value m1 to zero, the absolute values of spectral amplitude included in the two regions have the same value. Accordingly, in the case of the average value of region A, for example, this corresponds to obtaining a typical value of amplitude of this group with a spectrum in which converted amplitude (absolute value) is relatively large out of the first spectrum taken as one group, and in the case of the average value of region B, this corresponds to obtaining a typical value of amplitude of this group with a spectrum in which converted amplitude is relatively small out of the first spectrum taken as one group. As a result, these two typical values are parameters expressing an outline of the dynamic range of the first spectrum.

Next, in this embodiment, the same processing as carried out on the first spectrum is carried out on the second spectrum, and typical values corresponding to the respective groups of the second spectrum are obtained. A ratio between the typical value of the first spectrum and the typical value of the second spectrum in region A (specifically, a ratio of the typical value of the first spectrum to the typical value of the second spectrum) and a ratio between the typical value of the first spectrum and the typical value of the second spectrum in region B, are obtained. It is therefore possible to approximately obtain the ratio between the dynamic range of the first spectrum and the dynamic range of the second spectrum. The spectrum modification section according to this embodiment codes this ratio as spectrum modification information and outputs this information.

Figure 26:
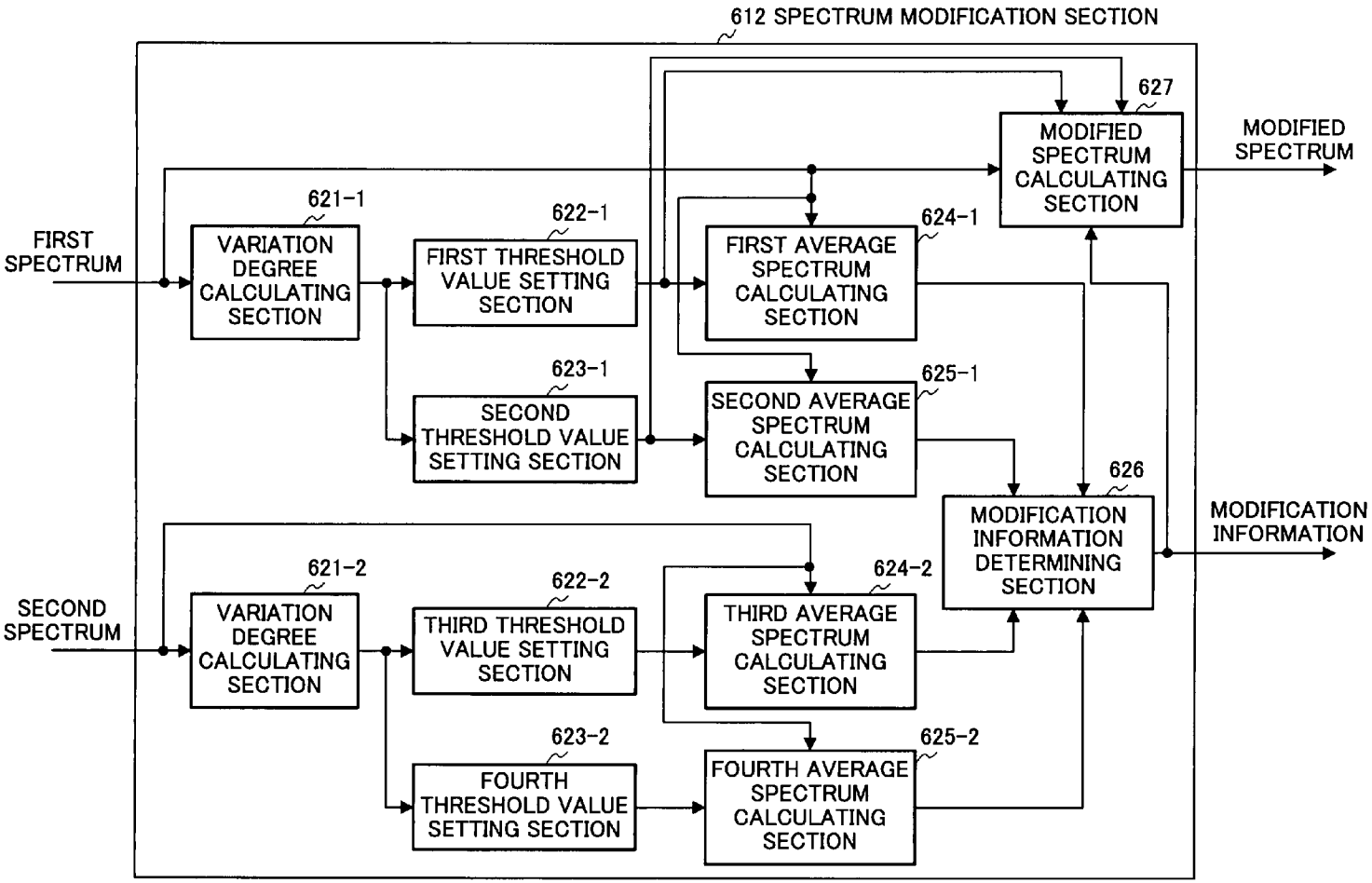
FIG. 26 is a block diagram showing the main configuration of internal part of a spectrum modification section according to Embodiment 6.

FIG. 26 is a block diagram showing the main configuration of the internal part of spectrum modification section 612.

Spectrum modification section 612 can be roughly classified into: a system that calculates typical values of the above-described respective groups of the first spectrum; a system that calculates typical values of the above-described respective groups of the second spectrum; modification information determining section 626 that determines modification information based on the typical values calculated by these two systems; and modified spectrum generating section 627 that generates a modified spectrum based on this modification information.

Specifically, the system that calculates the typical values of the first spectrum is made up of: variation degree calculating section 621-1; first threshold value setting section 622-1; second threshold value setting section 623-1; first average spectrum calculating section 624-1; and second average spectrum calculating section 625-1. The system that calculates the typical values of the second spectrum has also basically the same configuration as the system that calculates the typical values of the first spectrum. The same components in the drawings will be assigned the same reference numerals, and differences of the processing system are indicated with branch numbers after the reference numerals. Explanations about the same components will be omitted.

Variation degree calculating section 621-1 calculates "variation degree" from average value m1 of the first spectrum from amplitude distribution of inputted first spectrum S1(*k*), and outputs this to first threshold value setting section 622-1 and second threshold value setting section 623-1. Specifically, "variation degree" is standard deviation σ1 of the amplitude distribution of the first spectrum.

First threshold value setting section 622-1 obtains first threshold value TH1 using first spectrum standard deviation σ1 obtained at variation degree calculating section 621-1. Here, first threshold value TH1 is a threshold value for specifying a spectrum with relatively large absolute amplitude included in the above-described region A out of the first spectrum, and a value where a predetermined constant a is multiplied by standard deviation σ1 is used.

The operation of second threshold value setting section 623-1 is also the same as the operation of first threshold value setting section 622-1, but obtained second threshold value TH2 is a threshold value for specifying a spectrum with relatively small absolute amplitude included in region B out of the first spectrum, and a value where predetermined constant b (<a) is multiplied by standard deviation al is used.

First average spectrum calculating section 624-1 obtains a spectrum positioned on the outside of first threshold value TH1—an average value of amplitude of a spectrum included in region A (hereinafter referred to as a first average value)—and outputs the result to modification information determining section 626.

Specifically, first average spectrum calculating section 624-1 compares the amplitude (here, a value before conversion) of the first spectrum with a value (m1+TH1) where first threshold value TH1 is added to average value m1 of the first spectrum, and specifies a spectrum having larger amplitude than this value (step 1). Next, first average spectrum calculating section 624-1 compares the amplitude of the first spectrum with a value (m1−TH1) where first threshold value TH1 is subtracted from average value m1 of the first spectrum, and specifies a spectrum having smaller amplitude than this value (step 2). The amplitudes of the spectrums obtained in both step 1 and step 2 are converted so that the above-described average value m1 becomes zero, and the average values of the absolute values of the obtained converted values are calculated, and outputted to modification information determining section 626.

The second average spectrum calculating section obtains a spectrum positioned on the inside of second threshold value TH2—an average value of amplitude of the spectrum included in region B (hereinafter referred to as second average value)—and outputs the result to modification information determining section 626. The specific operation is the same as first average spectrum calculating section 624-1.

First average value and second average value obtained in the above-described processing are typical values for region A and region B of the first spectrum.

Processing for obtaining typical values of the second spectrum is basically the same as described above. However, the first spectrum and the second spectrum are different spectrums. A value where standard deviation σ2 of the second spectrum is multiplied by predetermined constant c is then used as third threshold value TH3 corresponding to first threshold value TH1, and a value where standard deviation σ2 of the second spectrum is multiplied by predetermined constant d (<c) is used as fourth threshold value TH4 corresponding to second threshold value TH2.

Modification information determining section 626 determines modification information as below using the first average value obtained at first average spectrum calculating section 624-1, the second average value obtained at second average spectrum calculating section 625-1, the third average value obtained at third average spectrum calculating section 624-2 and the fourth average value obtained at fourth average spectrum calculating section 625-2.

Namely, modification information determining section 626 calculates a ratio between the first average value and the third average value (hereinafter referred to as first gain), and a ratio between the second average value and the fourth average value (hereinafter referred to as second gain). Modification information determining section 626 is internally provided with a data table in which a plurality of coding candidates for modification information are stored. Modification information determining section 626 then compares the first gain and second gain with these coding candidates, selects the most similar coding candidate, and outputs an index indicating this coding candidate as modification information. This index is also transmitted to modified spectrum generating section 627.

Modified spectrum generating section 627 carries out modification of the first spectrum using the first spectrum that is the input signal, first threshold value TH1 obtained at first threshold value setting section 622-1, second threshold value TH2 obtained at second threshold value setting section 623-1, and modification information outputted from modification information determining section 626.

Figure 27:
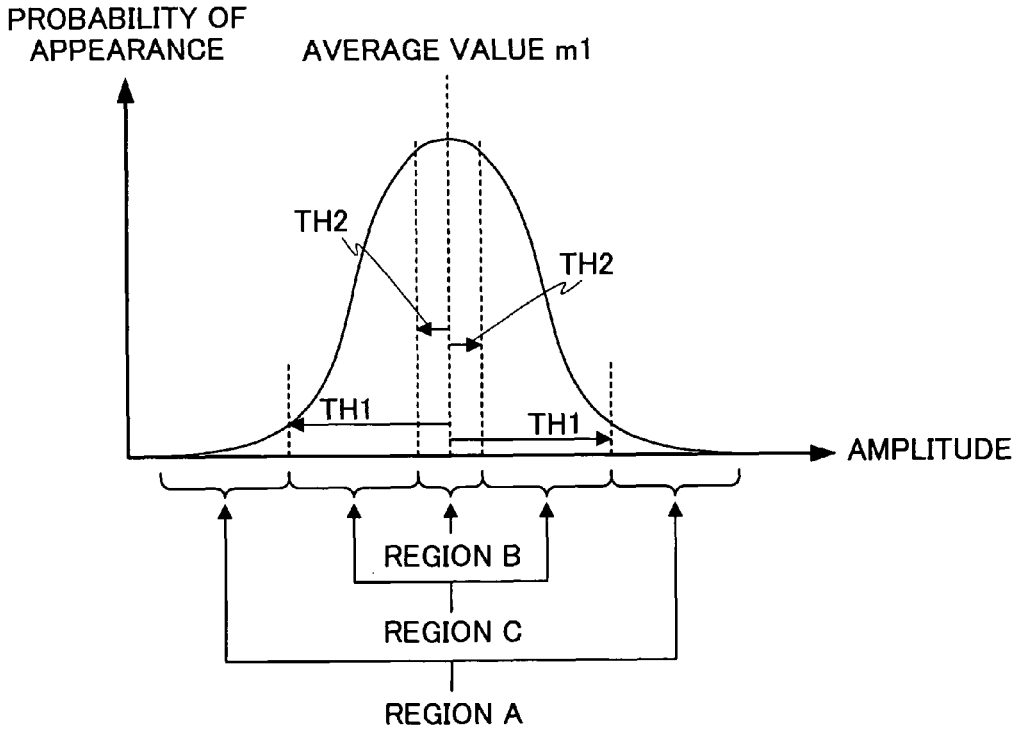
FIG. 27 illustrates a method for generating a modified spectrum.
Figure 28:
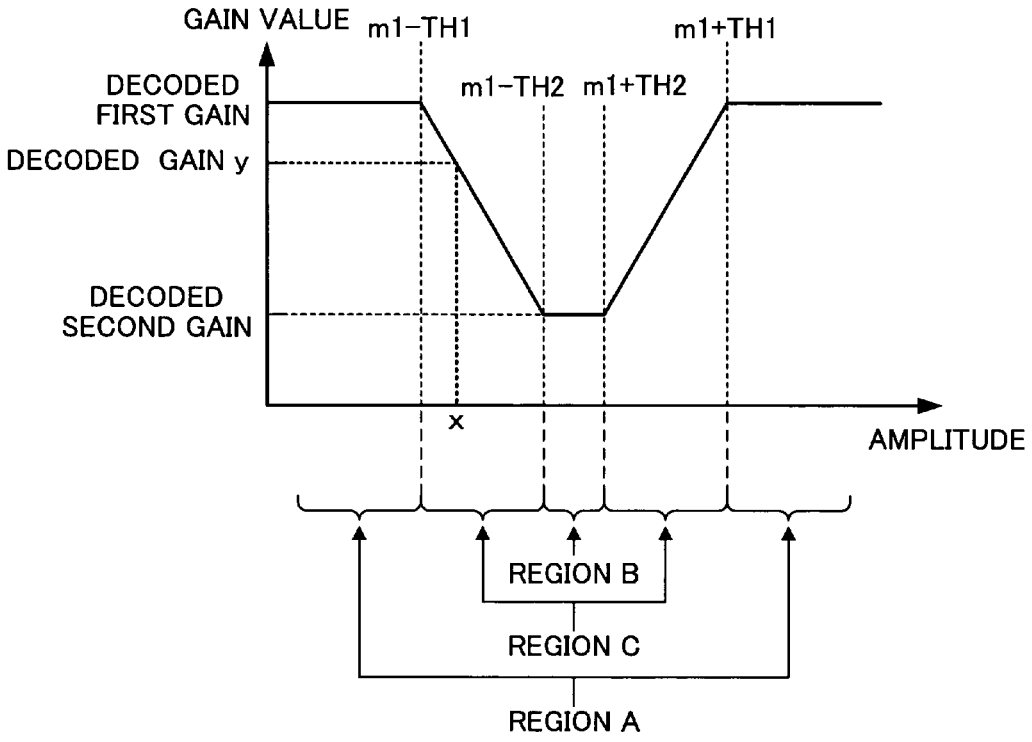
FIG. 28 illustrates a method for generating a modified spectrum.

FIG. 27 and FIG. 28 illustrate a method of generating a modified spectrum.

Modified spectrum generating section 627 generates a decoded value of a ratio between the first average value and the third average value (hereinafter referred to as decoded first gain) and a decoded value of a ratio between the second average value and the fourth average value (hereinafter referred to as decoded second gain) using modification information. These corresponding relationships are as shown in FIG. 27.

Next, modified spectrum generating section 627 specifies spectrums belonging to region A by comparing the first spectral amplitude value with first threshold value TH1, and multiplies the decoded first gain by these spectrums. Similarly, modified spectrum generating section 627 specifies spectrums belonging to region B by comparing the first spectrum amplitude value with second threshold value TH2, and multiplies the decoded second gain by these spectrums.

On the other hand, as shown in FIG. 28, coding information does not exist for spectrums belonging to a region (hereinafter, region C) between first threshold value TH1 and second threshold value TH2, out of the first spectrum. Modified spectrum generating section 627 uses gain having a value midway between the decoded first gain and the decoded second gain. For example, decoded gain y corresponding to given amplitude x may be obtained from a characteristic curve based on the decoded first gain, decoded second gain, first threshold value TH1 and second threshold value TH2, and the amplitude of the first spectrum may be multiplied by this gain.

Namely, decoded gain y is a linear interpolation value for the decoded first gain and decoded second gain.

Figure 29:
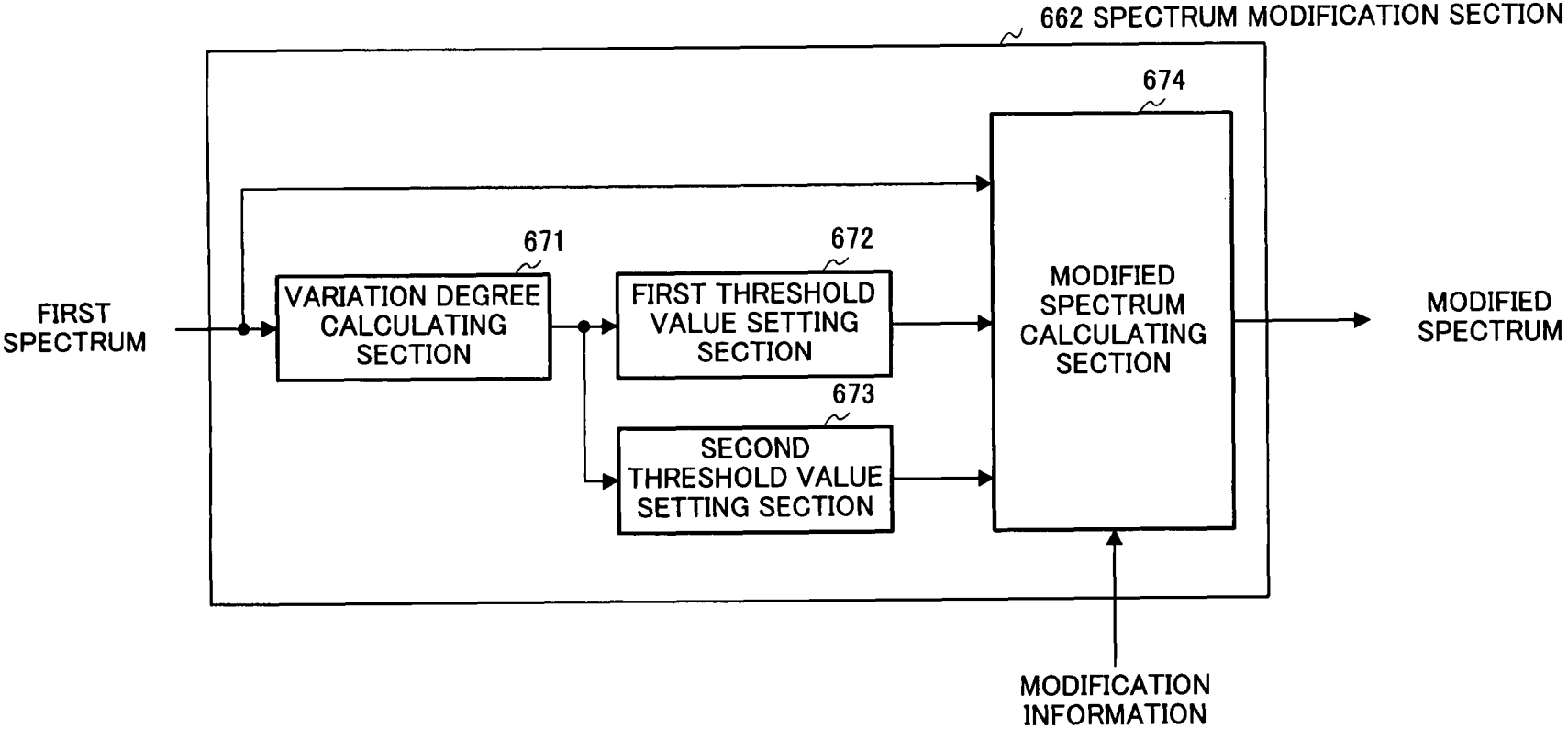
FIG. 29 is a block diagram showing the main configuration of the internal part of a spectrum modification section according to Embodiment 6.

FIG. 29 is a block diagram showing the main configuration of the internal part of spectrum modification section 662 used in the decoding apparatus. This spectrum modification section 662 corresponds to modification section 162 shown in Embodiment 1.

The basic operation is the same as the above-described spectrum modification section 612, and therefore detailed explanations will be omitted, but this spectrum modification section 662 only takes the first spectrum as a processing target, and therefore there is only one processing system.

According to this embodiment, amplitude distribution of the first spectrum and amplitude distribution of the second spectrum are respectively obtained, and divided into a group of relatively large absolute amplitude and a group of relatively small absolute amplitude. Then, typical values of the amplitudes for respective groups are obtained. The ratio of the dynamic range between the first spectrum and the second spectrum—modification information of the spectrum—is obtained and coded using the ratio of the typical values of amplitudes for the respective groups of the first spectrum and the second spectrum. As a result, it is possible to obtain modification information without using a function with a large amount of calculation such as an exponential function.

According to this embodiment, standard deviation is obtained from amplitude distribution of the first spectrum and second spectrum, and the first threshold value to the fourth threshold value are obtained based on this standard deviation. A threshold value is set based on the actual spectrum, so that it is possible to improve coding accuracy of modification information.

Further, according to this embodiment, the dynamic range of the first spectrum is controlled by adjusting the gain of the first spectrum using the decoded first gain and decoded second gain. The decoded first gain and decoded second gain are determined so that the first spectrum is close to the high frequency band of the second spectrum. The dynamic range of the first spectrum is then close to the dynamic range of the high frequency band of the second spectrum. Further, it is not necessary to use a function with a large amount of calculation such as an exponential function for calculation of the decoded first gain and decoded second gain.

In this embodiment, a case has been described as an example where the decoded first gain is larger than the decoded second gain, but there are cases where the decoded second gain is larger than the decoded first gain depending on the quality of the speech signal. Namely, there are cases where the dynamic range of the high frequency band of the second spectrum is larger than the dynamic range of the first spectrum. This kind of phenomena frequently occurs in the cases where the inputted speech signal is a sound such as a fricative. In this case also, it is possible to apply the spectrum modification method according to this embodiment.

Further, in this embodiment, a case has been described as an example where spectrums are divided into two groups, a group of relatively large absolute amplitude and a group of relatively small absolute amplitude. However, it is also possible to divide into larger numbers of groups so as to increase reproducibility of the dynamic range.

In addition, in this embodiment, a case has been described as an example where amplitude is converted using an average value as a reference and spectrums are divided into a group of relatively large amplitude and a group of relatively small amplitude based on the amplitude after conversion, but it is also possible to use the original amplitude value as is and carry out grouping of the spectrums based on the amplitude.

Moreover, in this embodiment, a case has been described as an example where standard deviation is used for calculating the variation degree of the absolute amplitude of the spectrum, but this is by no means limiting, and, for example, it is possible to use variance as the same statistical parameter as standard deviation.

Further, in this embodiment, a case has been described as an example where an average value of absolute amplitude of the spectrum for each group is used as a typical value of spectral amplitude of each group, but this is by no means limiting, and, for example, it is possible to use a central value of the absolute amplitude of the spectrum for each group.

Moreover, in this embodiment, a case has been described as an example where an amplitude value of each spectrum is used for adjustment of the dynamic range, but it is also possible to use a spectral energy value instead of the amplitude value.

Further, when a typical value corresponding to each group is obtained, in the case where amplitude of the spectrum originally has a positive or negative sign as with, for example, an MDCT coefficient, it is not necessary to convert the average value to zero, and a typical value corresponding to each group may be obtained simply using an absolute value of amplitude of the spectrum.

The above is a description of each of the embodiments of the present invention.

The coding apparatus and decoding apparatus of the present invention are by no means limited to each of the above-described embodiments, and various modifications thereof are possible.

The coding apparatus and decoding apparatus of the present invention can be loaded on a communication terminal apparatus and base station apparatus of a mobile communication system so as to make it possible to provide a communication terminal apparatus and base station apparatus having the same operation effects as described above.

Here, a case has been described as an example where the present invention is applied to a scaleable coding scheme, but the present invention may also be applied to other coding schemes.

Moreover, a case has been described as an example where the present invention is configured using hardware, but it is also possible to implement the present invention using software. For example, by describing the coding method (decoding method) algorithm according to the present invention in a programming language, storing this program in a memory and making an information processing section execute this program, it is possible to implement the same function as the coding apparatus (decoding apparatus) of the present invention.

Furthermore, each function block used to explain the above-described embodiments is typically implemented as an LSI constituted by an integrated circuit. These may be individual chips or may partially or totally contained on a single chip.

Furthermore, here, each function block is described as an LSI, but this may also be referred to as "IC", "system LSI", "super LSI", "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor in which connections and settings of circuit cells within an LSI can be reconfigured is also possible.

Further, if integrated circuit technology comes out to replace LSI's as a result of the development of semiconductor technology or a derivative other technology, it is naturally also possible to carry out function block integration using this technology. Application in biotechnology is also possible.

The present application is based on Japanese Patent Application No. 2004-145425 filed on May 14, 2004, Japanese Patent Application No. 2004-322953 filed on Nov. 5, 2004, and Japanese Patent Application No. 2005-133729 filed on Apr. 28, 2005, the entire content of which is expressly incorporated by reference herein.

INDUSTRIAL APPLICABILITY

The coding apparatus, decoding apparatus, and methods thereof according to the present invention can be applied to scaleable coding/decoding, and the like.

The invention claimed is:

1. A coding apparatus comprising:

a coder, including a processor, that codes estimated information of a high frequency band spectrum of an input signal having a wideband spectrum comprising a low frequency band spectrum and the high frequency band spectrum; and a limiter that acquires a first low frequency band spectrum in which a coded signal of the low frequency band spectrum of the input signal is decoded, and generates a second low frequency band spectrum by modifying a dynamic range of the first low frequency band spectrum to be closer to a dynamic range of a high frequency band spectrum, wherein the coder receives as input the wideband spectrum of the input signal as a reference signal, estimates, as the estimated information, a most similar spectrum to the high frequency band spectrum of the input signal using the wideband spectrum and the second low frequency band spectrum, and codes information about the estimated spectrum to supplant the high frequency band spectrum.

2. The coding apparatus according to claim 1, further comprising a transmitter that transmits dynamic range modification information used at the limiter together with coded information obtained by the coder.

3. The coding apparatus according to claim 1, wherein the limiter modifies the dynamic range of the first low frequency band spectrum so that an average deviation of the second low frequency band spectrum amplitude is equivalent to an average deviation of amplitude of the high frequency band spectrum.

4. The coding apparatus according to claim 1, wherein the limiter generates the second low frequency band spectrum by uniformly raising the amplitude of the first low frequency band spectrum to the power of a predetermined value within a range from 0 to 1.

5. The coding apparatus according to claim 1, wherein the coder comprises:

a pitch filter that has the second low frequency band spectrum as an internal state; and an estimator that estimates the high frequency band spectrum of the input signal using the pitch filter, wherein characteristics of the pitch filter corresponding to an estimation result of the estimator are coded.

6. The coding apparatus according to claim 5, wherein the pitch filter characteristics are indicated by the following transfer function:

$$P(z) = \frac{1}{1 - z^{-T}}$$

where

P(z): pitch filter transfer function, z: z conversion coefficient,

T: lag coefficient.

7. The coding apparatus according to claim 1, wherein the limiter estimates dynamic range modification information and generates the second low frequency band spectrum using the estimated dynamic range modification information.

8. The coding apparatus according to claim 1, wherein the limiter comprises:

a dynamic range calculator that calculates dynamic range information using the first low frequency band spectrum;

a modification information estimator that estimates modification information for modifying the dynamic range of the first low frequency band spectrum using the dynamic range information; and a modifier that modifies the dynamic range of the first low frequency band spectrum using the estimated modification information.

9. The coding apparatus according to claim 7, wherein the limiter comprises:

a modification information estimator that estimates the modification information for modifying the dynamic range of the first low frequency band spectrum using pitch information indicating periodicity of the input signal; and a modifier that modifies the dynamic range of the first low frequency band spectrum using the estimated modification information.

10. The coding apparatus according to claim 9, wherein the pitch information is configured using at least one of pitch gain and pitch period.

11. The coding apparatus according to claim 7, wherein the limiter comprises:

a modification information estimator that estimates the modification information for modifying the dynamic range of the first low frequency band spectrum using spectrum outline information of the input signal; and a modifier that modifies the dynamic range of the first low frequency band spectrum using the estimated modification information.

12. The coding apparatus according to claim 11, wherein the modification information estimator comprises:

a spectrum outline information storage unit that stores a plurality of candidates for spectrum outline information; and a dynamic range information storage unit that stores a plurality of candidates for dynamic range information, wherein:

a candidate for spectrum outline information corresponding to spectrum outline information of the input signal is selected from the spectrum outline information storage unit; and the modification information is estimated by selecting a candidate for dynamic range information corresponding to the selected candidate for spectrum outline information from the dynamic range information storage unit.

13. The coding apparatus according to claim 1, further comprising:

a first classifier that classifies the first low frequency band spectrum into a plurality of groups according to differences in amplitude;

a first typical value acquirer that acquires a typical value for amplitude for each group of the first low frequency band spectrum;

a second classifier that classifies the high frequency band spectrum into a plurality of groups according to differences in amplitude; and a second typical value acquirer that acquires a typical value for amplitude for each group of the high frequency band spectrum, wherein the limiter modifies the dynamic range of the first low frequency band spectrum based on the typical value for each group of the first low frequency band spectrum and the typical value for each group of the high frequency band spectrum.

14. The coding apparatus according to claim 13, wherein the limiter obtains amplitude between the typical values by carrying out linear interpolation on the typical values.

15. The coding apparatus according to claim 13, wherein the limiter modifies the dynamic range of the first low frequency band spectrum based on a ratio between the typical value for each group of the first low frequency band spectrum and the typical value for each group of the high frequency band spectrum.

16. The coding apparatus according to claim 13, wherein the first and second typical value acquirers acquire same kind of value from among an average value and a central value of the amplitude for each group.

17. A decoding apparatus comprising:

a converter, including a processor, that generates a first low frequency band spectrum in which a decoded signal of code of a low frequency band spectrum included in code generated in a coding apparatus is converted to a frequency domain signal;

a decoder that decodes code of a high frequency band spectrum included in the code generated in the coding apparatus; and a limiter that generates a second low frequency band spectrum in which the dynamic range of the first low frequency band spectrum is modified to be closer to the dynamic range of the high frequency band spectrum of a signal input to the coding apparatus according to spectrum modification information included in the code generated in the coding apparatus, wherein the decoder generates information about estimation of the high frequency band spectrum by decoding the code of the high frequency band spectrum and generates an estimated spectrum of the high frequency band spectrum by applying the information about estimation of the high frequency band spectrum to the second low frequency band spectrum.

18. A decoding apparatus comprising:

a converter, including a processor, that generates a first low frequency band spectrum in which a decoded signal of code of a low frequency band spectrum included in code generated in a coding apparatus is converted to a frequency domain signal;

a decoder that decodes code of a high frequency band spectrum included in the code generated in the coding apparatus; and a limiter that generates a second low frequency band spectrum in which a dynamic range of the first low frequency band spectrum is modified so as to become close to a dynamic range of the high frequency band spectrum of a signal input to the coding apparatus, wherein:

the limiter estimates dynamic range modification information based on the first low frequency band spectrum and generates the second low frequency band spectrum by applying the estimated dynamic range modification information to the first low frequency band spectrum; and the decoder generates information about estimation of the high frequency band spectrum by decoding the code of the high frequency band spectrum and generates an estimated spectrum of the high frequency band spectrum by applying the information about estimation of the high frequency band spectrum to the second low frequency band spectrum.

19. A communication terminal apparatus comprising the coding apparatus according to claim 1.

20. A base station apparatus comprising the coding apparatus according to claim 1.

21. A communication terminal apparatus comprising the decoding apparatus according to claim 17.

22. A base station apparatus comprising the decoding apparatus according to claim 17.

23. A communication terminal apparatus comprising the decoding apparatus according to claim 18.

24. A base station apparatus comprising the decoding apparatus according to claim 18.

25. A coding method comprising:

coding, by a coder, estimated information of a high frequency band spectrum of an input signal having a wideband spectrum comprising a low frequency band spectrum and the high frequency band spectrum;

acquiring a first low frequency band spectrum in which a coded signal of the low frequency band spectrum of the input signal is decoded; and generating a second low frequency band spectrum by modifying a dynamic range of the first low frequency band spectrum to be closer to a dynamic range of a high frequency hand spectrum, wherein coding estimated information of a high frequency band spectrum of an input signal receives as input the wideband spectrum of the input signal as a reference signal, estimates, as the estimated information, a most similar spectrum to the high frequency band spectrum of the input signal using the wideband spectrum and the second low frequency band spectrum, and codes information about the estimated spectrum to supplant the high frequency band spectrum.

26. A decoding method comprising:

generating a first low frequency band spectrum in which a decoded signal of code of a low frequency band spectrum included in code generated in a coding apparatus is converted to a frequency domain signal;

decoding, by a decoder, code of a high frequency band spectrum included in the code generated in the coding apparatus;

acquiring spectrum modification information included in the code generated in the coding apparatus; and generating a second low frequency band spectrum in which a dynamic range of the first low frequency band spectrum is modified to be closer to a dynamic range of a high frequency band spectrum of a signal input to the coding apparatus, wherein decoding code of a high frequency band spectrum generates information about estimation of the high frequency band spectrum by decoding the code of the high frequency band spectrum and generates an estimated spectrum of the high frequency band spectrum by applying the estimated information to the second low frequency band spectrum.

27. A decoding method comprising:

generating a first low frequency band spectrum in which a decoded signal of code of a low frequency band spectrum included in code generated in a coding apparatus is converted to a frequency domain signal;

decoding, by a decoder, code of a high frequency band spectrum included in the code generated in the coding apparatus; and generating a second low frequency band spectrum in which a dynamic range of the first low frequency band spectrum is modified to be closer to a dynamic range of a high frequency band spectrum of a signal input to the coding apparatus, wherein:

generating a second low frequency band spectrum estimates dynamic range modification information based on the first low frequency band spectrum and generates the second low frequency band spectrum by applying the estimated dynamic range modification information to the first low frequency band spectrum; and decoding code of a high frequency band spectrum generates information about estimation of the high frequency band spectrum by decoding the code of the high frequency band spectrum and generates an estimated spectrum of the high frequency band spectrum by applying the estimated information to the second low frequency band spectrum.

* * * * *

UNITED STATES PATENT AND TRADEMARK OFFICE

CERTIFICATE OF CORRECTION

PATENT NO. : 8,417,515 B2
APPLICATION NO. : 11/596085
DATED : April 9, 2013
INVENTOR(S) : Masahiro Oshikiri et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1022 days.

In the Claims:

Claim 25, column 30, line 28 incorrectly reads:

"frequency hand spectrum,"

and should read:

"frequency band spectrum,".

Signed and Sealed this
Fifteenth Day of April, 2014

Michelle K. Lee

Michelle K. Lee
*Deputy Director of the United States Patent and Trademark Office*